US008654023B2

(12) United States Patent
Brown et al.

(10) Patent No.: US 8,654,023 B2
(45) Date of Patent: Feb. 18, 2014

(54) MULTI-LAYERED MULTI-BAND ANTENNA WITH PARASITIC RADIATOR

(75) Inventors: Forrest James Brown, Carson City, NV (US); Ryan James Orsi, San Diego, CA (US); Matthew Robert Foster, San Diego, CA (US)

(73) Assignee: Dockon AG, Zurich (CH)

( * ) Notice: Subject to any disclaimer, the term of this patent is extended or adjusted under 35 U.S.C. 154(b) by 183 days.

(21) Appl. No.: 13/402,817

(22) Filed: Feb. 22, 2012

(65) Prior Publication Data

US 2013/0057441 A1 Mar. 7, 2013

Related U.S. Application Data

(60) Provisional application No. 61/530,902, filed on Sep. 2, 2011.

(51) Int. Cl.
*H01Q 7/00* (2006.01)

(52) U.S. Cl.
USPC ..... 343/748; 343/749; 343/741; 343/866

(58) Field of Classification Search
USPC ..... 343/741, 745, 748, 749, 866
See application file for complete search history.

(56) References Cited

U.S. PATENT DOCUMENTS

| | | | |
|---|---|---|---|
| 4,809,009 | A | 2/1989 | Grimes et al. |
| 5,061,938 | A | 10/1991 | Zahn et al. |
| 5,198,826 | A | 3/1993 | Ito |
| 5,376,942 | A | 12/1994 | Shiga |
| 5,565,881 | A | 10/1996 | Phillips |
| 5,751,252 | A | 5/1998 | Phillips |
| 5,771,024 | A | 6/1998 | Reece |
| 5,771,025 | A | 6/1998 | Reece |
| 5,781,159 | A | 7/1998 | Desargant |

(Continued)

FOREIGN PATENT DOCUMENTS

| | | | |
|---|---|---|---|
| EP | 1672735 | A1 | 6/2006 |
| EP | 1684379 | A1 | 7/2006 |

(Continued)

OTHER PUBLICATIONS

International Patent Application No. PCT/US12/53235: International Search Report and Written Opinion dated Nov. 2, 2012, 12 pages.

(Continued)

*Primary Examiner* — Hoang V Nguyen
(74) *Attorney, Agent, or Firm* — Baker & Hostetler LLP

(57) ABSTRACT

Embodiments provide multi-band, compound loop antennas (multi-band antennas). Embodiments of the multi-band antennas produce signals at two or more frequency bands, with the two or more frequency bands capable of being adjusted and tuned independently of each other. Embodiments of a multi-band antenna are comprised of at least one electric field radiator and at least one monopole formed out of the magnetic loop. At a particular frequency, the at least one electric field radiator in combination with various portions of the magnetic loop resonate and radiate an electric field at a first frequency band. At yet another particular frequency, the at least one monopole in combination with various portions of the magnetic loop resonate and radiate an electric field at a second frequency band. The shape of the magnetic loop can be tuned to increase the radiation efficiency at particular frequency bands and enable the multi-band operation of antenna embodiments.

10 Claims, 18 Drawing Sheets

(56) References Cited

U.S. PATENT DOCUMENTS

| | | | | |
|---|---|---|---|---|
| 5,883,599 | A | 3/1999 | Hall | |
| 6,437,750 | B1 | 8/2002 | Grimes et al. | |
| 6,545,647 | B1 | 4/2003 | Sievenpiper et al. | |
| 6,593,886 | B2 | 7/2003 | Schantz | |
| 6,677,901 | B1 | 1/2004 | Nalbandian | |
| 6,853,341 | B1 | 2/2005 | Hellgren | |
| 6,864,856 | B2 | 3/2005 | Lynch et al. | |
| 6,933,895 | B2 | 8/2005 | Mendolia et al. | |
| 7,215,292 | B2 | 5/2007 | McLean | |
| 7,528,788 | B2 | 5/2009 | Dunn et al. | |
| 7,639,207 | B2 | 12/2009 | Sievenpiper et al. | |
| 7,692,595 | B2 | 4/2010 | Kim | |
| 7,768,466 | B2 | 8/2010 | Chi | |
| 7,855,689 | B2 | 12/2010 | Fukui et al. | |
| 7,978,141 | B2 | 7/2011 | Chi | |
| 8,144,065 | B2 | 3/2012 | Brown | |
| 8,149,173 | B2 | 4/2012 | Brown | |
| 8,164,528 | B2 | 4/2012 | Brown | |
| 2007/0024514 | A1 | 2/2007 | Phillips et al. | |
| 2007/0080878 | A1 | 4/2007 | McLean | |
| 2007/0182658 | A1 | 8/2007 | Ozden | |
| 2009/0073048 | A1 | 3/2009 | Kim | |
| 2009/0160717 | A1 | 6/2009 | Tsutsumi et al. | |
| 2009/0224990 | A1 | 9/2009 | Cezanne et al. | |
| 2010/0103061 | A1 | 4/2010 | Yung et al. | |
| 2010/0103064 | A1 | 4/2010 | Yang | |
| 2010/0271264 | A1 | 10/2010 | Li | |
| 2011/0012800 | A1 * | 1/2011 | Shamblin et al. | 343/746 |
| 2011/0018776 | A1 | 1/2011 | Brown | |
| 2011/0018777 | A1 | 1/2011 | Brown | |

FOREIGN PATENT DOCUMENTS

| | | | |
|---|---|---|---|
| EP | 1753080 | A1 | 9/2008 |
| JP | 03-050922 | A | 3/1991 |
| JP | 05-183317 | A | 7/1993 |
| JP | 03-258546 | A | 9/2003 |
| WO | WO 00/25385 | A | 5/2000 |
| WO | WO 2005/062422 | A1 | 7/2005 |

OTHER PUBLICATIONS

"Antenna Theory: A review," Balanis, Proc. IEEE, Jan. 1992, 80(1).
U.S. Appl. No. 13/402,777, filed Feb. 22, 2012, Brown Forrest James.
U.S. Appl. No. 13/402,806, filed Feb. 22, 2012, Brown Forrest James.
Chan et al., "Printed Antenna Composed of a Bow-tie Dipole and a Loop," IEEE Antennas and Propagation International Symposium 2007, Jun. 2007, pp. 681-684, IEEE, 1-4244-0878-4/07.
Cheng, D.K. , "Optimization techniques for antenna arrays," Proc. IEEE, vol. 59, pp. 1664-1674, Dec. 1971.
Chu,L.J. "Physical Limitations of Omni-Directional Antennas," J. Appl. Phys., vol. 19, pp. 1163-1175, Dec. 1948.
Collin, R.E. and S. Rothschild, "Evaluation of antenna Q," IEEE Trans Antennas Propagat 44, 1996., 23-27.
Fante, R.L. "Quality factor of general ideal antennas," IEEE Trans. Antennas Propag., AP-17(2), pp. 151-155, Mar. 1969.
Grimes ,D.M. and C.A. Grimes, "The Complex Poynting Theorem Reactive Power, Radiative Q, and Limitations on Electrically Small Antennas," IEEE 1995, pp. 97-101.
Grimes et al., "Bandwidth and Q of Antennas Radiating TE and TM Modes", IEEE Transactions on Electromagnetic Compatibility, 37(2), May 1995.
Grimes et al., "Minimum Q of Electrically Small Antennas: A Critical Review", Microwave and Optical Technology Letters, 28(3), Feb. 5, 2001.
Grimes,C.A. and D.M. Grimes, "The Poynting Theorems and The Potential for Electrically Small Antennas," Proceedings IEEE Aerospace Conference, pp. 161-176, 1997.
Hansen, R.C., "Fundamental limitations in antennas," Proc. IEEE, 69, pp. 170-182, Feb. 1981.
Harrington, R.F. "Effect of Antenna Size on Gain, Bandwitdth and Efficiency", J. Res. Nat. Bur. Stand., 64D, pp. 1-12, Jan.-Feb. 1960.
Irwin, J. David, "Equivalent Impedances", Basic Engineering Circuit Analysis, 7th Ed., A Wiley First Edition, John Wiley and Sons, New York, 2002, pp. 273 to 274.
McLean, J.S., "The Application of the Method of Moments to Analysis of Electrically Small 'Compound' Antennas," IEEE EMC Symp., Record, Aug. 1995, pp. 119-124.
McLean, James S., "A Re-examination of the Fundamental Limits on the Radiation Q of Electrically Small Antennas", IEEE Transactions on Antennas and Propagation, 44(5), May 1996.
Nilsson et al., "Maximum Power Transfer", ElectricCircuits 6th Edition, 2001, pp. 512-514.
Overfelt et al., "A Colocated Magnetic Loop, Electric Dipole Array Antenna (Preliminary Results)", Naval Air Warfare Center Weapons Division, China Lake, CA, Sep. 1994.
Sten, J.C.-E. and A. Hujanen, "Notes on the quality factor and bandwidth of radiating systems", Electrical Engineering 84, pp. 189-195, 2002.
Tefiku,F., and C.A. Grimes, "Coupling Between Elements of Electrically Small Compound Antennas," Microwave and Optical Technology Letters, 22(1), pp. 16-21, 1999.
Wheeler, H.A. , "Small antennas," IEEE Trans. Antennas Propagat., AP-23, pp. 462-1169, Jul. 1975.
Wheeler, H.A. "Fundamental Limitations of Small Antennas", Proc. IRE, 35, pp. 1479-1484, Dec. 1947.
Yaghjian, A.D. and S.R. Best, "Impedance, bandwidth, and Q of antennas," IEEE Trans. Antennas Propagat., 53, pp. 1298-1324, Apr. 2005.
Yazdanboost, K.Y., Kohno, R., "Ultra wideband L-loop antenna" in Ultra-Wideband, 2005. ICU 2005. 2005 IEEE International Conference on. Issue Date: Sep. 5-8, 2005, pp. 201-205. ISBN: 0-7803-9397-X.

* cited by examiner

MULTI-LAYERED MULTI-BAND ANTENNA WITH PARASITIC RADIATOR

CROSS-REFERENCES TO RELATED APPLICATIONS

This application is a non-provisional application of U.S. Provisional Application No. 61/530,902, filed Sep. 2, 2011, which is incorporated herein by reference in its entirety.

BRIEF DESCRIPTION

Embodiments provide a multi-band, compound loop antenna (multi-band antenna). Embodiments of the multi-band antenna produce signals at two or more frequency bands, with the two or more frequency bands capable of being adjusted and tuned independently of each other. Embodiments of a multi-band antenna are comprised of at least one electric field radiator and at least one monopole/dipole formed out of the magnetic loop. At a particular frequency, the at least one electric field radiator in combination with various portions of the magnetic loop resonate and radiate an electric field at a first frequency band. At yet another particular frequency, the at least one monopole in combination with various portions of the magnetic loop resonate and radiate an electric field at a second frequency band. The shape of the magnetic loop can be tuned to increase the radiation efficiency at particular frequency bands and enable the multi-band operation of antenna embodiments.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND

The ever decreasing size of modern telecommunication devices creates a need for improved antenna designs. Known antennas in devices such as mobile/cellular telephones provide one of the major limitations in performance and are almost always a compromise in one way or another.

In particular, the efficiency of the antenna can have a major impact on the performance of the device. A more efficient antenna will radiate a higher proportion of the energy fed to it from a transmitter. Likewise, due to the inherent reciprocity of antennas, a more efficient antenna will convert more of a received signal into electrical energy for processing by the receiver.

In order to ensure maximum transfer of energy (in both transmit and receive modes) between a transceiver (a device that operates as both a transmitter and receiver) and an antenna, the impedance of both should match each other in magnitude. Any mismatch between the two will result in sub-optimal performance with, in the transmit case, energy being reflected back from the antenna into the transmitter. When operating as a receiver, the sub-optimal performance of the antenna results in lower received power than would otherwise be possible.

Known simple loop antennas are typically current fed devices, which produce primarily a magnetic (H) field. As such they are not typically suitable as transmitters. This is especially true of small loop antennas (i.e. those smaller than, or having a diameter less than, one wavelength). In contrast, voltage fed antennas, such as dipoles, produce both electric (E) fields and H fields and can be used in both transmit and receive modes.

The amount of energy received by, or transmitted from, a loop antenna is, in part, determined by its area. Typically, each time the area of the loop is halved, the amount of energy which may be received/transmitted is reduced by approximately 3 dB depending on application parameters, such as initial size, frequency, etc. This physical constraint tends to mean that very small loop antennas cannot be used in practice.

Compound antennas are those in which both the transverse magnetic (TM) and transverse electric (TE) modes are excited in order to achieve higher performance benefits such as higher bandwidth (lower Q), greater radiation intensity/power/gain, and greater efficiency.

In the late 1940s, Wheeler and Chu were the first to examine the properties of electrically small (ELS) antennas. Through their work, several numerical formulas were created to describe the limitations of antennas as they decrease in physical size. One of the limitations of ELS antennas mentioned by Wheeler and Chu, which is of particular importance, is that they have large radiation quality factors, Q, in that they store, on time average more energy than they radiate. According to Wheeler and Chu, ELS antennas have high radiation Q, which results in the smallest resistive loss in the antenna or matching network and leads to very low radiation efficiencies, typically between 1-50%. As a result, since the 1940's, it has generally been accepted by the science world that ELS antennas have narrow bandwidths and poor radiation efficiencies. Many of the modern day achievements in wireless communications systems utilizing ELS antennas have come about from rigorous experimentation and optimization of modulation schemes and on air protocols, but the ELS antennas utilized commercially today still reflect the narrow bandwidth, low efficiency attributes that Wheeler and Chu first established.

In the early 1990s, Dale M. Grimes and Craig A. Grimes claimed to have mathematically found certain combinations of TM and TE modes operating together in ELS antennas that exceed the low radiation Q limit established by Wheeler and Chu's theory. Grimes and Grimes describe their work in a journal entitled "Bandwidth and Q of Antennas Radiating TE and TM Modes," published in the IEEE Transactions on Electromagnetic Compatibility in May 1995. These claims sparked much debate and led to the term "compound field antenna" in which both TM and TE modes are excited, as opposed to a "simple field antenna" where either the TM or TE mode is excited alone. The benefits of compound field antennas have been mathematically proven by several well respected RF experts including a group hired by the U.S. Naval Air Warfare Center Weapons Division in which they concluded evidence of radiation Q lower than the Wheeler-Chu limit, increased radiation intensity, directivity (gain), radiated power, and radiated efficiency (P. L. Overfelft, D. R. Bowling, D. J. White, "Colocated Magnetic Loop, Electric Dipole Array Antenna (Preliminary Results)," Interim rept., September 1994).

Compound field antennas have proven to be complex and difficult to physically implement, due to the unwanted effects of element coupling and the related difficulty in designing a low loss passive network to combine the electric and magnetic radiators.

There are a number of examples of two dimensional, non-compound antennas, which generally consist of printed strips of metal on a circuit board. However, these antennas are voltage fed. An example of one such antenna is the planar inverted F antenna (PIFA). The majority of similar antenna designs also primarily consist of quarter wavelength (or some multiple of a quarter wavelength), voltage fed, dipole antennas.

Planar antennas are also known in the art. For example, U.S. Pat. No. 5,061,938, issued to Zahn et al., requires an expensive Teflon substrate, or a similar material, for the antenna to operate. U.S. Pat. No. 5,376,942, issued to Shiga, teaches a planar antenna that can receive, but does not transmit, microwave signals. The Shiga antenna further requires an expensive semiconductor substrate. U.S. Pat. No. 6,677,901, issued to Nalbandian, is concerned with a planar antenna that requires a substrate having a permittivity to permeability ratio of 1:1 to 1:3 and which is only capable of operating in the HF and VHF frequency ranges (3 to 30 MHz and 30 to 300 MHz). While it is known to print some lower frequency devices on an inexpensive glass reinforced epoxy laminate sheet, such as FR-4, which is commonly used for ordinary printed circuit boards, the dielectric losses in FR-4 are considered to be too high and the dielectric constant not sufficiently tightly controlled for such substrates to be used at microwave frequencies. For these reasons, an alumina substrate is more commonly used. In addition, none of these planar antennas are compound loop antennas.

The basis for the increased performance of compound field antennas, in terms of bandwidth, efficiency, gain, and radiation intensity, derives from the effects of energy stored in the near field of an antenna. In RF antenna design, it is desirable to transfer as much of the energy presented to the antenna into radiated power as possible. The energy stored in the antenna's near field has historically been referred to as reactive power and serves to limit the amount of power that can be radiated. When discussing complex power, there exists a real and imaginary (often referred to as a "reactive") portion. Real power leaves the source and never returns, whereas the imaginary or reactive power tends to oscillate about a fixed position (within a half wavelength) of the source and interacts with the source, thereby affecting the antenna's operation. The presence of real power from multiple sources is directly additive, whereas multiple sources of imaginary power can be additive or subtractive (canceling). The benefit of a compound antenna is that it is driven by both TM (electric dipole) and TE (magnetic dipole) sources which allows engineers to create designs utilizing reactive power cancelation that was previously not available in simple field antennas, thereby improving the real power transmission properties of the antenna.

In order to be able to cancel reactive power in a compound antenna, it is necessary for the electric field and the magnetic field to operate orthogonal to each other. While numerous arrangements of the electric field radiator(s), necessary for emitting the electric field, and the magnetic loop, necessary for generating the magnetic field, have been proposed, all such designs have invariably settled upon a three-dimensional antenna. For example, U.S. Pat. No. 7,215,292, issued to McLean, requires a pair of magnetic loops in parallel planes with an electric dipole on a third parallel plane situated between the pair of magnetic loops. U.S. Pat. No. 6,437,750, issued to Grimes et al., requires two pairs of magnetic loops and electric dipoles to be physically arranged orthogonally to one another. U.S. Patent Application US2007/0080878, filed by McLean, teaches an arrangement where the magnetic dipole and the electric dipole are also in orthogonal planes.

Commonly owned U.S. patent application Ser. No. 12/878,016 teaches a linear polarized, multi-layered planar compound loop antenna. Commonly owned U.S. patent application Ser. No. 12/878,018 teaches a linear polarized, single-sided compound loop antenna. Finally, commonly owned U.S. patent application Ser. No. 12/878,020 teaches a linear polarized, self-contained compound loop antenna. These commonly owned patent applications differ from prior antennas in that they are compound loop antennas having one or more magnetic loops and one or more electric field radiators physically arranged in two dimensions, rather than requiring three-dimensional arrangements of the magnetic loops and the electric field radiators as in the antenna designs by McLean and Grimes et al.

DETAILED DESCRIPTION

Figure 1A:
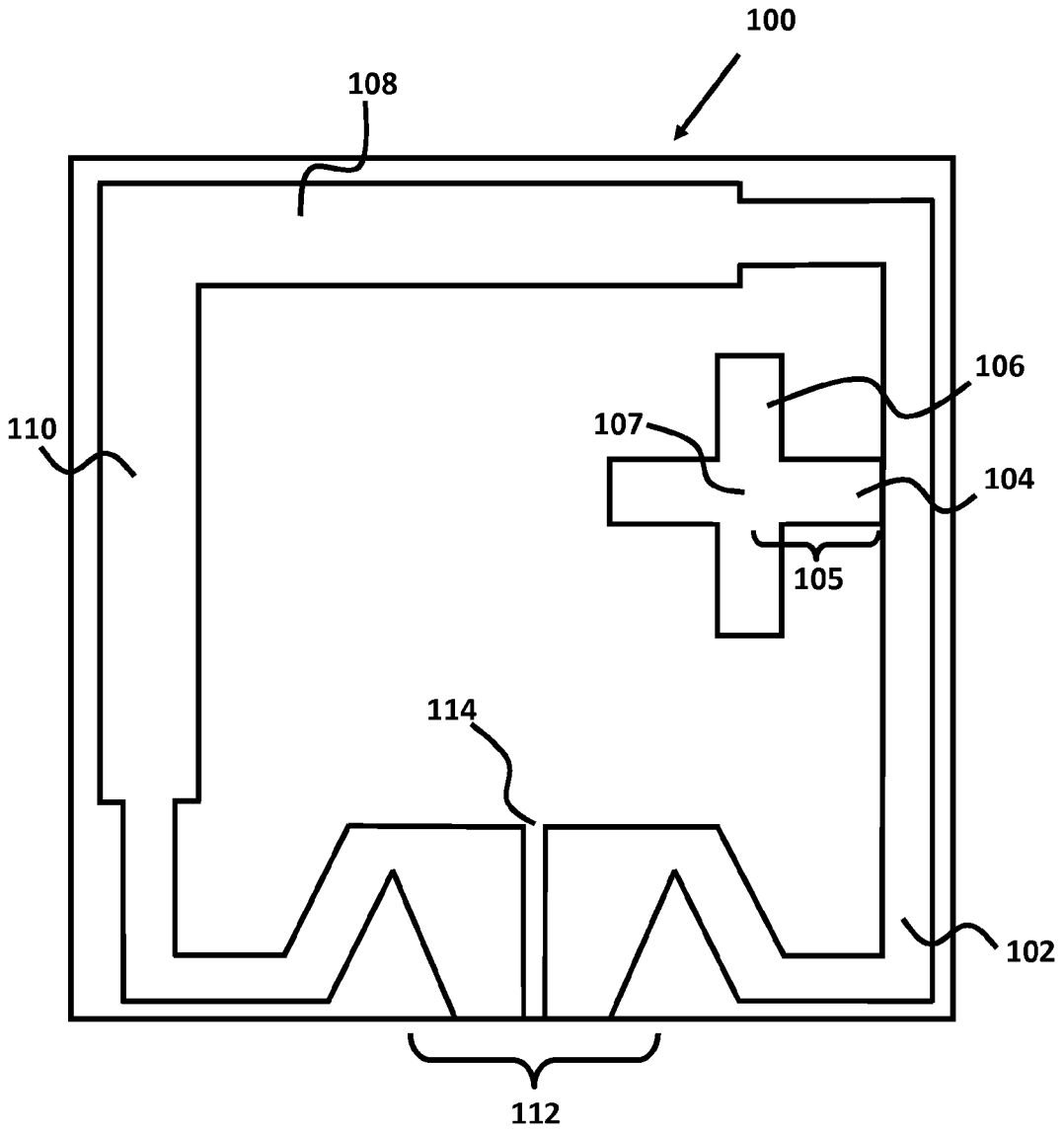
FIG. 1A is a plan view of a single-sided 2.4 GHz self-contained, circular polarized, compound loop antenna in accordance with an embodiment.

Embodiments provide single-sided and multi-layered circular polarized, self-contained, compound loop antennas (circular polarized CPL antennas). Embodiments of the circular polarized CPL antennas produce circular polarized signals by using two electric field radiators physically oriented orthogonal to each other, and by ensuring that the two electric field radiators are positioned such that an electrical delay between the two electric field radiators results in the two electric field radiators emitting their respective electric fields out of phase. Ensuring the proper electrical delay between the two electric field radiators also maintains high efficiency of the antenna and it improves the axial ratio of the antenna.

Single-sided compound loop antennas, multi-layered compound loop antennas, and self-contained compound loop antennas are discussed in U.S. patent application Ser. Nos. 12/878,016, 12/878,018, 12/878,020, which are incorporated herein by reference in their entirety.

Circular polarization refers to the phenomena where the electric field and the magnetic field continuously rotate while maintaining their respective orthogonality as the electromagnetic waves generated by the antenna propagate away from the antenna through space. Circular polarization can penetrate through moisture and obstacles better than linear polarization. This makes it suitable for humid environments, metropolitan areas with many buildings and trees, and satellite applications.

With linear polarized antennas, the transmitter and the receiver of separate devices must have a similar orientation so as to enable the receiver to receive the strongest signal from the transmitter. For instance, if the transmitter is oriented vertically, the receiver should also be oriented vertically in order to receive the strongest signal. On the other hand, if the transmitter is oriented vertically, and the receiver is slightly skewed or leaning at an angle rather than being vertical, then the receiver will receive a weaker signal. Similarly, if the transmitter is skewed at an angle, and the receiver is vertical, then the receiver will receive a weaker signal. This can be a significant problem with certain types of mobile devices, such as cellular-based phones, where the receiver in the phone can have a constantly changing orientation, or where the orientation of the phone with the best signal strength is also the orientation of the phone that is least comfortable for a user. Therefore, when designing an antenna to be used in a portable electronic device or for a satellite receiver, it is impossible to predict the orientation of the receiving device, which can consequently lead to degraded performance of the receiver. In the case of portable electronic devices, the orientation of the receiver is bound to change unpredictably depending on what the user is doing while using the portable electronic device.

A possible solution to this problem is to use multiple receivers, or multiple transmitters, arranged at different orientations, thus increasing the quality of the signal received by the receiver. For example, a first receiver may be vertical, a second receiver may be oriented at a 45 degree angle, and a third receiver may be horizontal. This would enable the receiver to receive signals that are linear vertical polarized, linear horizontal polarized, and linear polarized signals at an angle. In this case, the receiver would receive the strongest signals when the signal transmitted from the transmitter matches the orientation of one of the receivers. However, the use of multiple receivers/transmitters requires larger receiving/transmitting devices to house the multiple receivers/transmitters. In addition, the benefit of the multiple receivers/transmitters is offset by the power consumption required to power the additional receivers/transmitters.

In circular polarization, the transmitter and the receiver do not have to be oriented similarly as the propagated signals are constantly rotating on their own accord. Hence, regardless of the orientation of the receiver, the receiver will receive the same signal strength. As noted above, in circular polarization the electric field and the magnetic field continuously rotate while maintaining their respective orthogonality as the electric field and the magnetic field propagate through space.

FIG. 1A illustrates an embodiment of a single-sided, 2.4 GHz, circular polarized CPL antenna 100 with a length of approximately 2.92 centimeters and a height of approximately 2.92 centimeters. While particular dimensions are noted for this antenna design and other embodiments disclosed herein, it is to be understood that the present invention is not limited to a particular size or frequency of operation and that antennas using different sizes, frequencies, components and operational characteristics can be developed without departing from the teachings of the present invention.

The antenna 100 consists of a magnetic loop 102, a first electric field radiator 104 directly coupled to the magnetic loop 102, and a second electric field radiator 106 orthogonal to the first electric field radiator 104. Both of the electric field radiators 102 and 104 are physically located on the inside of the magnetic loop 102. While the electric field radiators 104 and 106 can also be positioned on the outside of the magnetic loop, it is preferable to have the electric field radiators 104 and 106 located on the inside of the magnetic loop 102 for maximum antenna performance. Both the first electric field radiator 104 and the second electric field radiator 106 are quarter-wave monopoles, but alternative embodiments can use monopoles that are some multiple of a quarter-wave.

Compound loop antennas are capable of operating in both transmit and receive modes, thereby enabling greater performance than known loop antennas. The two primary components of a CPL antenna are a magnetic loop that generates a magnetic field (H field) and an electric field radiator that emits an electric field (E field). The H field and the E field must be orthogonal to each other to enable the electromagnetic waves emitted by the antenna to effectively propagate through space. To achieve this effect, the electric field radiator is positioned at the approximate 90 degree electrical position or the approximate 270 degree electrical position along the magnetic loop. The orthogonality of the H field and the E field can also be achieved by positioning the electric field radiator at a point along the magnetic loop where current flowing through the magnetic loop is at a reflective minimum. The point along the magnetic loop of a CPL antenna where current is at a reflective minimum depends on the geometry of the magnetic loop. For example, the point where current is at a reflective minimum may be initially identified as a first area of the magnetic loop. After adding or removing metal to the magnetic loop to achieve impedance matching, the point where current is at a reflective minimum may change from the first area to a second area.

Returning to FIG. 1A, the electric field radiators 104 and 106 can be coupled to the magnetic loop 102 at the same 90 or 270 degree connection point or at the same connection point where current flowing through the magnetic loop 102 is at a reflective minimum. Alternatively, the first electric field radiator can be positioned at a first point along the magnetic loop where current is at a reflective minimum, and the second electric field radiator can be positioned at a different point along the magnetic loop where current is also at a reflective minimum. The electric field radiators need not be directly coupled to the magnetic loop. Alternatively, each of the electric field radiators can be connected to the magnetic loop 102 with a narrow electrical trace in order to add inductive delay. When the electric field radiators are placed within the magnetic loop, in particular, care must be taken to ensure that the radiators do not electrically couple with other portions of the antenna, such as the transition 108 or counterpoise 110 further described below, which can undermine the performance or operability of the antenna, unless some form of coupling is desired, as further described below.

As noted, the antenna 100 includes a transition 108 and a counterpoise 110 to the first electric field radiator 104 and the second electric field radiator 106. The transition 108 consists of a portion of the magnetic loop 102 that has a width greater than the width of the magnetic loop 102. The function of the transition 108 is further described below. The built-in counterpoise 110 allows the antenna 100 to be completely independent of any ground plane or the chassis of the product using the antenna. Embodiments of the antenna 100, and similarly of alternative embodiments of circular polarized CPL antennas, need not include a transition and/or a counterpoise.

The transition, in part, delays voltage distribution around the magnetic loop and sets the impedance for the counterpoise such that the voltage that appears in the magnetic loop and the transition does not cancel the voltage that is being emitted by the electric field radiator. When the counterpoise and the electric field radiator are positioned 180 degrees out of phase from each other in an antenna, the gain of the antenna can be increased irrespective of any ground plane nearby. It is also to be understood that the transition can be adjusted in its length and width to match the voltages that appear in the counterpoise.

The antenna 100 further includes a balun 112. A balun is a type of electrical transformer that can convert electrical signals that are balanced about ground (differential) to signals that are unbalanced (single-ended) and vice versa. Specifically, a balun presents high impedance to common-mode signals and low impedance to differential-mode signals. The balun 112 serves the function of canceling common mode current. In addition, the balun 112 tunes the antenna 100 to the desired input impedance and tunes the impedance of the overall magnetic loop 102. The balun 112 is substantially triangular shaped and consists of two parts divided by a middle gap 114. Alternative embodiments of the antenna 100 and, similarly, alternative embodiments of self-contained CPL antennas and circular polarized CPL antennas, need not include the balun.

The length of the transition 108 can be set based on the frequency of operation of the antenna. For a higher frequency antenna, where the wavelength is shorter, a shorter transition can be used. On the other hand, for a lower frequency antenna, where the wavelength is longer, a longer transition 108 can be used. The transition 108 can be adjusted independently of the counterpoise 110.

The counterpoise 110 is referred to as being built-in because the counterpoise 110 is formed from the magnetic loop 102. Consequently, the self-contained counterpoise antenna does not require a ground plane to be provided by the device using the antenna. The length of the counterpoise 110 can be adjusted as necessary to obtain the desired antenna performance.

In the case of a simple, quarter wave monopole, the ground plane and the counterpoise are one and the same. However, the ground plane and the counterpoise do not necessarily need to be the same. The ground plane is where the reference phase point is located, while the counterpoise is what sets the farfield polarization. In the case of the self-contained CPL antenna, the transition functions to create a 180 degree phase delay to the counterpoise which also moves the reference phase point corresponding to the ground into the counterpoise, making the antenna independent of the device to which the antenna is connected. When a balun is included at the ends of the magnetic loop, then both ends of the magnetic loop are the antenna's ground. If an antenna does not include a counterpoise, then the portion of the magnetic loop approximately 180 degrees from the electric field radiators will still act as a ground plane.

Embodiments of the antenna 100 are not limited to including the transition 108 and/or the counterpoise 110. Thus, the antenna 100 may not include the transition 108, but still include the counterpoise 110. Alternatively, the antenna 100 may not include the transition 108 or the counterpoise 110. If the antenna 100 does not include the counterpoise 110, then the gain and efficiency of the antenna 100 would drop slightly. If the antenna 100 does not include the counterpoise, the electric field radiators will still look for a counterpoise approximately 180 degrees from the electric field radiators, such as a piece of metal (e.g., the left side of the magnetic loop 102 of FIG. 1A), that can function as the counterpoise. While the left side of the magnetic loop 102 (without the counterpoise) could function in a similar manner, it would not be as effective (due to its reduced width) as having the counterpoise 110 with a width greater than the width of the magnetic loop 102. In other words, anything connected to a minimum reflective current point along the magnetic loop will look for a counterpoise 180 degrees from that minimum reflective current point. In the antenna 100, the counterpoise 110 is positioned approximately 180 degrees from the minimum reflective current point used for both electric field radiators 104 and 106. However, as noted above, while the counterpoise 110 has benefits, removing the counterpoise 110 will only have marginal effects on the gain and performance of the antenna 100.

While FIG. 1A illustrates a plan view of antenna 100 with the first electric field radiator oriented horizontally and the second electric field radiator oriented vertically, in some embodiments the electric field radiators can be oriented along different angles on the same plane. While the exact position of the two electric field radiators can vary, it is important is for the two electric field radiators to be positioned orthogonal to each other for the antenna 100 to operate as a circular polarized CPL antenna. For instance, the first electric field radiator can be tilted at a 45 degree angle, with an electrical trace coupling the tilted first electric field radiator to the magnetic loop. The second electric field radiator need only be orthogonal to the first electric field radiator to enable the antenna to produce circular polarized signals. In such an embodiment, the substantially cross shape formed by the two intersecting electric field radiators would be tilted 45 degrees.

Figure 1B:
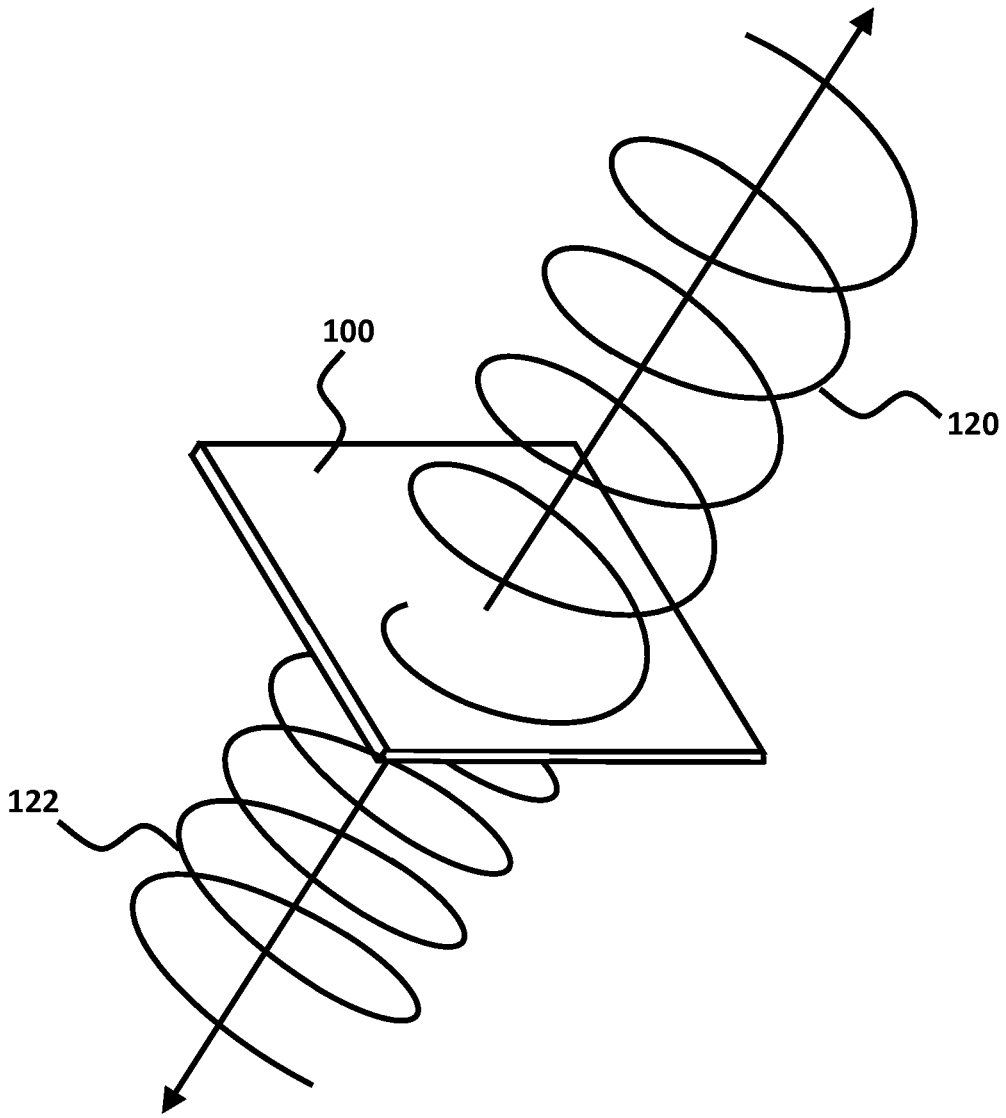
FIG. 1B illustrates the 2.4 GHz antenna from FIG. 1A with right-hand circular polarization signals propagating along the positive z-direction and left-hand circular polarization signals propagating along the negative z-direction.

The circular polarized CPL antenna 100 is planar. Consequently, the right-hand circular polarization (RHCP) is transmitted in a first direction that is perpendicular to the plane formed by the antenna 100, along the positive z-direction. The left-hand circular polarization (LHCP) is transmitted in a second direction that is opposite the first direction, along the negative z-direction. FIG. 1B illustrates the RHCP 120 is radiated from the front of the antenna 100, while the LHCP 122 is radiated from the back of the antenna 100.

At lower frequencies, arranging the second electric field radiator orthogonal to the second electric field may not work if there is not enough delay between the first electric field radiator and the second electric field radiator. If there is not enough delay between the two electric field radiators, the two electric field radiators may emit their respective electric fields at the same time or not sufficiently out of phase, resulting in cancellation of their electric fields. The electric field cancelation results in lower efficiency and gain of the antenna, since less of the electric field is emitted into space. This can also result in a cross polarized antenna rather than a circular polarized antenna.

As a solution, referring back to FIG. 1A, the two electric field radiators can be positioned along different points of the magnetic loop. Thus, the second electric field radiator 106 need not be positioned on top of the first electric field radiator 104. For instance, one of the electric field radiators can be positioned at the 90 degree phase point, while the second electric field radiator can be positioned at the 270 degree phase point. As noted above, the magnetic loop in a CPL antenna can have multiple points along the magnetic loop where current is at a reflective minimum. One of the electric field radiators can then be positioned at a first point where current is at a reflective minimum, and the second electric field radiator can be positioned at second point where current is also at a reflective minimum.

Figure 2A:
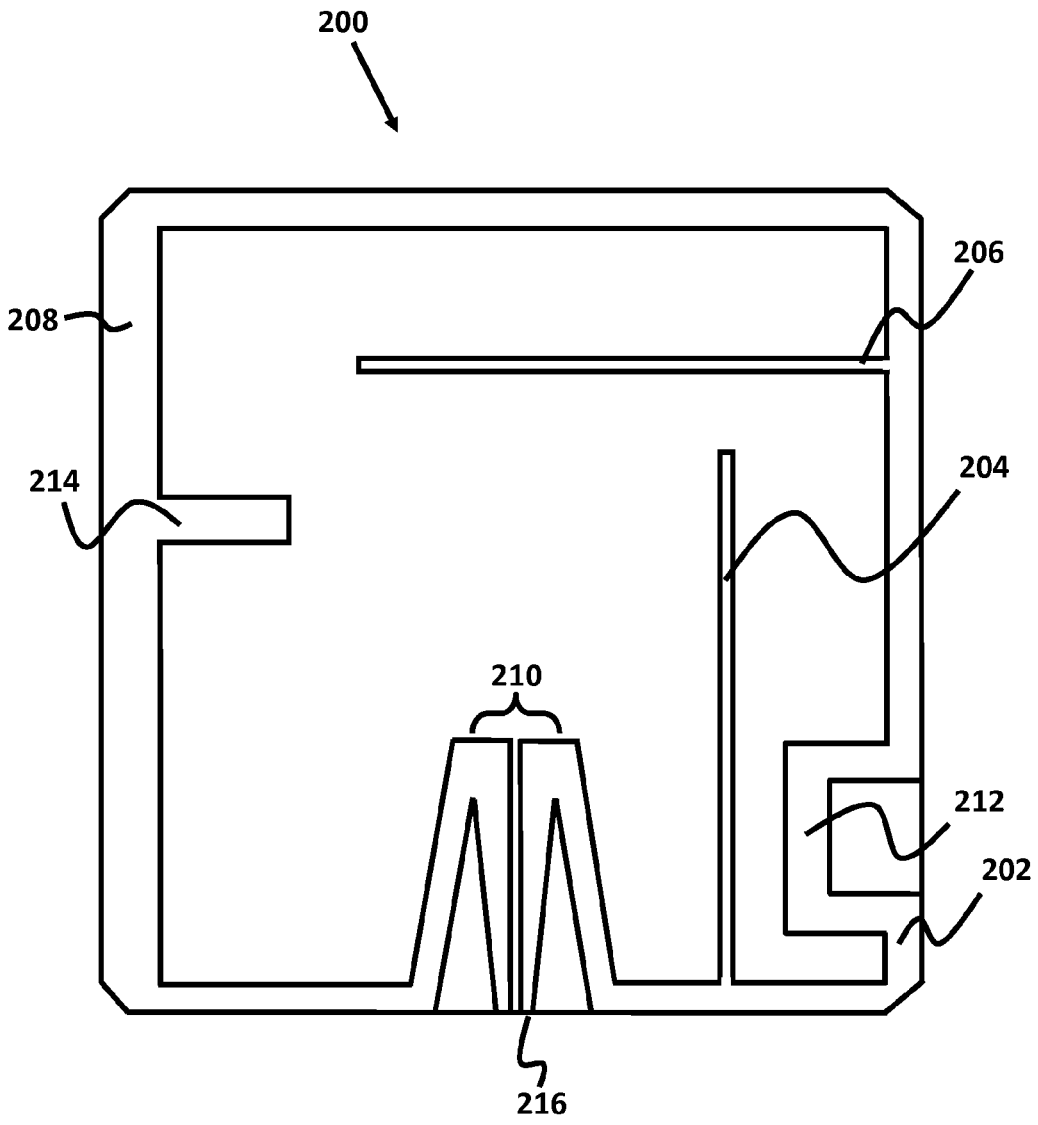
FIG. 2A is a plan view of a single-sided 402 MHz self-contained, circular polarized, compound loop antenna with two electric field radiators positioned along two different minimum reflective current points in accordance with an embodiment.

In the antenna 100 from FIG. 1A, both of the electric field radiators 104 and 106 are connected at the same reflective minimum point. However, in alternative embodiments of the antenna 100, the first electric field radiator 104 can be connected to a first point along the magnetic loop 102, and the second electric field radiator 106 can be connected to a second point along the magnetic loop 102, such as is illustrated in FIG. 2A. As noted above, however, the two electric field radiators, even if not in physical contact with one another, will still need to be positioned orthogonally with respect to each other for the antenna to have circular polarization, which is also illustrated in FIG. 2A.

In the antenna 100 of FIG. 1A, operating at a frequency of 2.4 GHz, the distance 105 between the first electric field radiator 104 and the second electric field radiator 106 is long enough to ensure that the first electric field radiator 104 is out of phase with the second electric field radiator 106. In the antenna 100, the center point 107 is the feed point for the second electric field radiator.

In the antenna 100, current flows into the antenna 100 via the right half of the balun 112, along the magnetic loop 102, into the first electric field radiator 104, into the second electric field radiator 106, through the transition 108, through the counterpoise 110, and out through the left side of the balun 112.

FIG. 2A illustrates an embodiment of a single-sided, 402 MHz, self-contained, circular polarized CPL antenna 200. The antenna 200 includes two electric field radiators 204 and 206 positioned along two different reflective minimum points. The 402 MHz antenna 200 has a length of approximately 15 centimeters and a height of approximately 15 centimeters. The antenna 200 does not include a transition, but it does include a counterpoise 208. The counterpoise 208 spans the length of the left side of the magnetic loop 202 and has a width that is twice the width of the magnetic loop 202. However, these dimensions are not fixed and the counterpoise length and width can be tuned to maximize antenna gain and performance. The antenna 200 also includes a balun 210, even though alternative embodiments of the antenna 200 need not include the balun 210. In the antenna 200, the balun 210 is physically located on the inside of the magnetic loop 202. However, the balun 210 can also be positioned physically on the outside of the magnetic loop 202.

In the antenna 200, current flows into the antenna 200 at the feed point 216 via the right half of the balun 210. The current then flows right along the magnetic loop 202. The first electric field radiator 204 is positioned to the right of the balun 210, along the bottom half segment of the magnetic loop 202. Current flows into and along the entire length of the first electric field radiator 204, continues to flow along the magnetic loop 202 and through the delay loop 212. The current then flows through the entire length of the second electric field radiator 206 and continues to flow through the top side of the magnetic loop 202, through the counterpoise 208, and into the delay stub 214, etc.

As noted, the antenna 200 includes a small delay loop 212 that protrudes into the magnetic loop 202. The delay loop 212 is used to adjust the delay between the first electric field radiator 204 and the second electric field radiator 206. The first electric field radiator 204 is positioned at the 90 degree phase point, while the second electric field radiator 206 is positioned at the 180 degree phase point. The width of the two electric field radiators 204 and 206 is the same. The width and length of the two electric field radiators 204 and 206 can be varied to tune the operating frequency of the antenna and to tune the axial ratio of the antenna.

The axial ratio is the ratio of orthogonal components of an electric field. A circularly polarized field is made up of two orthogonal electric field components of equal amplitude. For instance, if the amplitudes of the electric field components are not equal or almost equal, the result is an elliptical polarized field. The axial ratio is computed by taking the log of the first electric field in one direction divided by the second electric field orthogonal to the first electric field. In a circular polarized antenna it is desirable to minimize the axial ratio.

The length and width of the delay loop 212, as well as the thickness of the trace making up the delay loop 212, can be tuned as necessary to achieve the necessary delay between the two electric field radiators. Having the delay loop 212 protrude into the magnetic loop 202, i.e., positioned on the inside of the magnetic loop 202, optimizes the axial ratio of the antenna 200. However, the delay loop 212 can also protrude out of the magnetic loop 202. In other words, the delay loop 212 increases the electrical length between the first electric field radiator 204 and the second electric field radiator 206. The delay loop 212 need not be substantially rectangular shaped. Embodiments of the delay loop 212 can be curved, zig-zag shaped, or any other shape that would substantially slow the flow of electrons along the delay loop 212, thus ensuring that the electric field radiators are out of phase with each other.

One or more delay loops can be added to an antenna to achieve the proper delay between the two electric field radiators. For instance, FIG. 2A illustrates an antenna 200 with a single delay loop 212. However, rather than having the single delay loop 212, an alternative embodiment of the antenna 200 can have two or more delay loops.

The antenna 200 further includes a stub 214 on the left side of the magnetic loop 202. The stub 214 is directly coupled to the magnetic loop 202. The stub 214 capacitively couples to the second electric field radiator 206, electrically lengthening the electric field radiator 206 to tune the impedance match into band. In the antenna 200, the second electric field radiator 206 cannot be made physically longer, as lengthening the electric field radiator 206 in that manner would make the electric field radiator 206 capacitively couple to the counterpoise 208, thereby degrading antenna performance.

As noted above, as illustrated in FIG. 2A, the second electric field radiator 206 would normally have needed to be longer than its length illustrated in FIG. 2A. Specifically, the second electric field radiator 206 would have had to be longer by as much as the length of the stub 214. However, had the electric field radiator 206 been longer, it would have capacitively coupled to the left side of the magnetic loop 202. The use of the stub enables the second electric field radiator 206 to appear electrically longer. The electrical length of the electric field radiator 206 can be tuned by moving the stub 214 up and down along the left side of the magnetic loop 202. Moving the stub 214 higher along the left side of the magnetic loop 202 results in the electric field radiator 206 being electrically longer. On the other hand, moving the stub 214 lower along the left side of the magnetic loop 202 results in the electric field radiator 206 appearing electrically shorter. The electrical length of the electric field radiator 206 can also be tuned by changing the physical size of the stub 214.

Figure 2B:
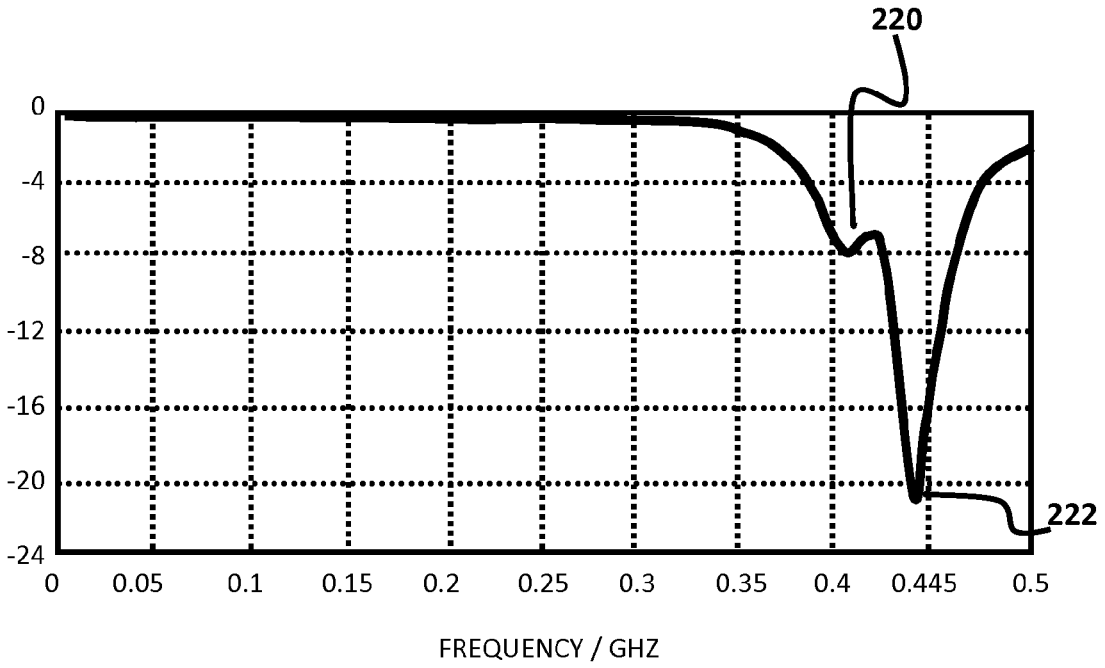
FIG. 2B is a graph illustrating the return loss for the single-sided 402 MHz antenna from FIG. 2A.

FIG. 2B is a graph illustrating the return loss the antenna 200, without the stub 214. Therefore, FIG. 2B illustrates the return loss for an antenna 200 having two electric field radiators with different electrical lengths. When two electric field radiators are of different electrical length, the return loss shows two dips at different frequencies. The first dip 220 and the second dip 222 correspond to frequencies where the impedance of the antenna is matched. Each electric field radiator produces its own resonance. Each resonance respectively produces multiple dips in terms of return loss. In the antenna 200, the first electric field radiator 204 produces a slightly higher resonance, corresponding to the second dip 222, than the second electric field radiator 206 because of its proximity along the magnetic loop 202 to the feed point 216. On the other hand, the second electric field radiator 206 produces a lower resonance, corresponding to the first dip 220, because of the longer length between the feed point 216 and the second electric field radiator 206. As mentioned above, the stub 214 electrically lengthens the second electric field radiator 206. This consequently moves the first dip 220 and makes the first dip 220 match the second dip 222.

Figure 3:
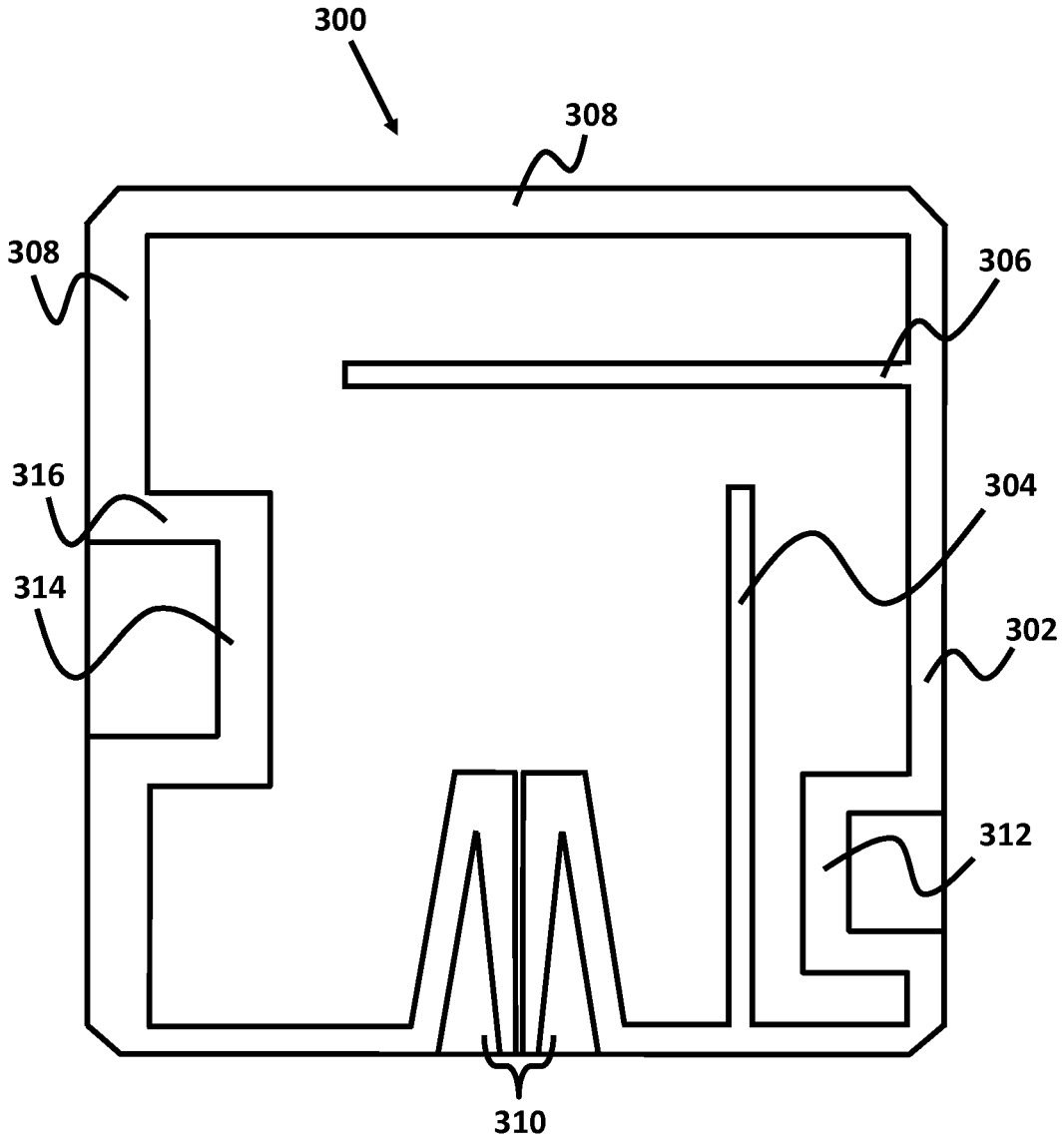
FIG. 3 is a plan view of an embodiment of a single-sided 402 MHz self-contained, circular polarized, compound loop antenna using two delay loops.

FIG. 3 is a plan view illustrating an alternative embodiment of a single-sided, 402 MHz, self-contained, circular polarized antenna 300 having two delay loops. The antenna 300 has a length of approximately 15 centimeters and a height of approximately 15 centimeters. The antenna 300 consists of a magnetic loop 302, a first electric field radiator 304 positioned along a first point where current is at a reflective minimum, and a second electric field radiator 306 positioned along a second point where current is at a reflective minimum. The antenna 300 also includes a counterpoise 308 and a balun 310. In contrast to antenna 200 from FIG. 2A, the antenna 300 does not include a stub 214, but includes two delay loops, a first delay loop 312 along the right side of the magnetic loop 302 and a second delay loop 314 along the right side of the magnetic loop 302. The second delay loop 314 is used to adjust the electrical delay between the two electric field radiators 304 and 306. In antenna 300, the top portion 316 of the second delay loop 314 capacitively couples to the second electric field radiator 306, performing a similar function as the stub 214 from antenna 200 by electrically lengthening the second electric field radiator 306.

When an antenna includes two or more delay loops, the two or more delay loops need not be of the same dimensions. For instance, in antenna 300 the first delay loop 312 is almost half as small as the second delay loop 314. Alternatively, the second delay loop 314 could have been replaced by two smaller delay loops. The delay loops can be added to any side of the magnetic loop, and a single antenna can have delay loops in one or more sides of the magnetic loop.

The proper delay between the two electric field radiators can be achieved without the use of delay loops by increasing the overall length of the magnetic loop. A magnetic loop 302 would therefore need to be larger if it did not include the delay loops 312 and 314 to ensure the proper delay between the first electric field radiator 304 and the second electric field radiator 306. Thus, the use of delay loops can be used as a space saving technique during antenna design, i.e., the overall size of the antenna can be reduced by moving various components to a physical position on the inside of the magnetic loop 302.

FIGS. 2A and 3 are examples of antennas with magnetic loops whose corners are cut at about a 45 degree angle. Cutting the corners of the magnetic loop at an angle improves the efficiency of the antenna. Having a magnetic loop with corners forming approximately 90 degree angles affects the flow of the current flowing through the magnetic loop. When the current flowing through the magnetic loop hits a 90 degree angle corner, it makes the current ricochet, with the reflected current flowing either against the main current flow or forming an eddy pool. The energy lost as a consequence of the 90 degree corners can affect negatively the performance of the antenna, most notably in smaller antenna embodiments. Cutting the corners of the magnetic loop at approximately a 45 degree angle improves the flow of current around the corners of the magnetic loop. Thus, the angled corners enable the electrons in the current to be less impeded as they flow through the magnetic loop. While cutting the corners at a 45 degree angle is preferable, alternative embodiments that are cut at an angle different than 45 degrees are also possible. Any CPL antenna can have a magnetic loop with corners cut off at an angle to improve antenna performance, but cut corners are not always necessary.

Figure 4:
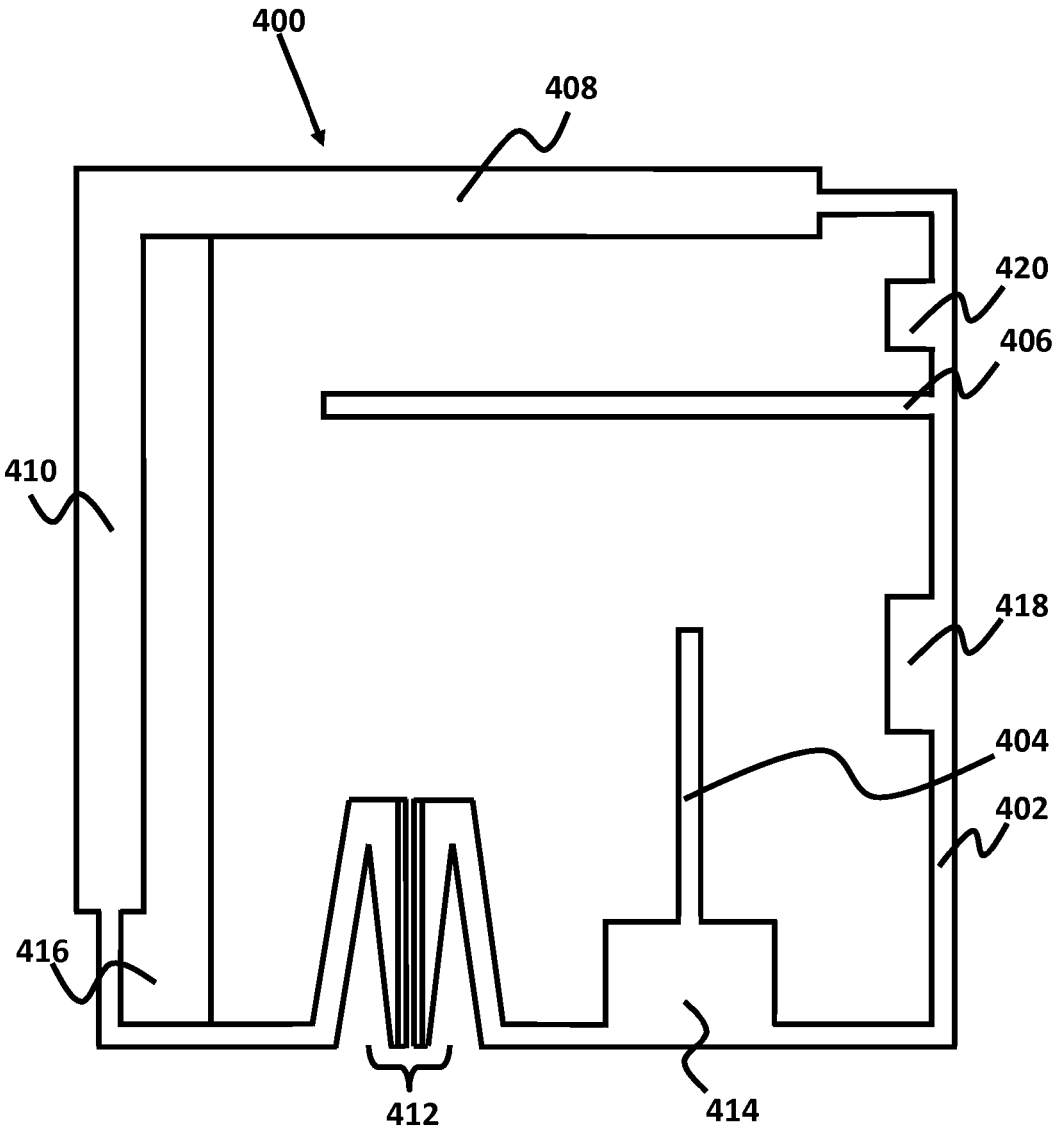
FIG. 4 is a plan view of one side of an embodiment of a double-sided 402 MHz self-contained, circular polarized, compound loop antenna using one electric field radiator and a patch on the back side of the antenna acting as the second electric field radiator.

Instead of using loops to adjust the delay between the two electric field radiators in an antenna, one or more substantially rectangular metal stubs can be used to adjust the delay between the two electric field radiators. FIG. 4 illustrates an embodiment of a double-sided (multi-layered), 402 MHz, self-contained, circular polarized antenna 400. The antenna 400 consists of a magnetic loop 402, a first electric field radiator 404 (vertical), a second electric field radiator 406 (horizontal), a transition 408, a counterpoise 410, and a balun 412.

The first electric field radiator 406 is attached to a square patch 414 which electrically lengthens the first electric field radiator 406. The square patch 414 is directly coupled to the magnetic loop 402. The dimensions of the square patch 414 can be adjusted accordingly based on how the electric field radiator 406 is to be tuned. The antenna 400 also includes back patch 416 located on the back side of the substrate upon which the antenna is applied. In particular, the back patch 416 spans the entire length of the left side of the magnetic loop 402. The back patch 416 radiates vertically, along with the first electric field radiator 404, and out of phase with the second electric field radiator 406. The back patch 416 is not electrically connected to the magnetic loop, and as such it is a parasitic electric field radiator. Thus, the antenna 400 is an example of a circular polarized CPL antenna having two vertical elements acting as electric field radiators and only one horizontal element acting as a first electric field radiator. Other embodiments could include many different combinations of vertical elements operating together and many different combinations of horizontal elements operating together, and as long as those vertical elements and horizontal elements are out of phase as described herein, the antenna will be circular polarized.

The antenna 400 further includes a first delay stub 418 and a second delay stub 420. The two delay stubs 418 and 420 are substantially rectangular shaped. The delay stubs 418 and 420 are used to adjust the delay between the first electric field radiator 404 and the second electric field radiator 406. While FIG. 4 illustrates the two delay stubs 418 and 420 protruding into the magnetic loop 402, alternatively the two delay stubs 418 and 420 can be arranged such that the two delay stubs 418 and 420 protrude out of the magnetic loop 402.

Figure 5:
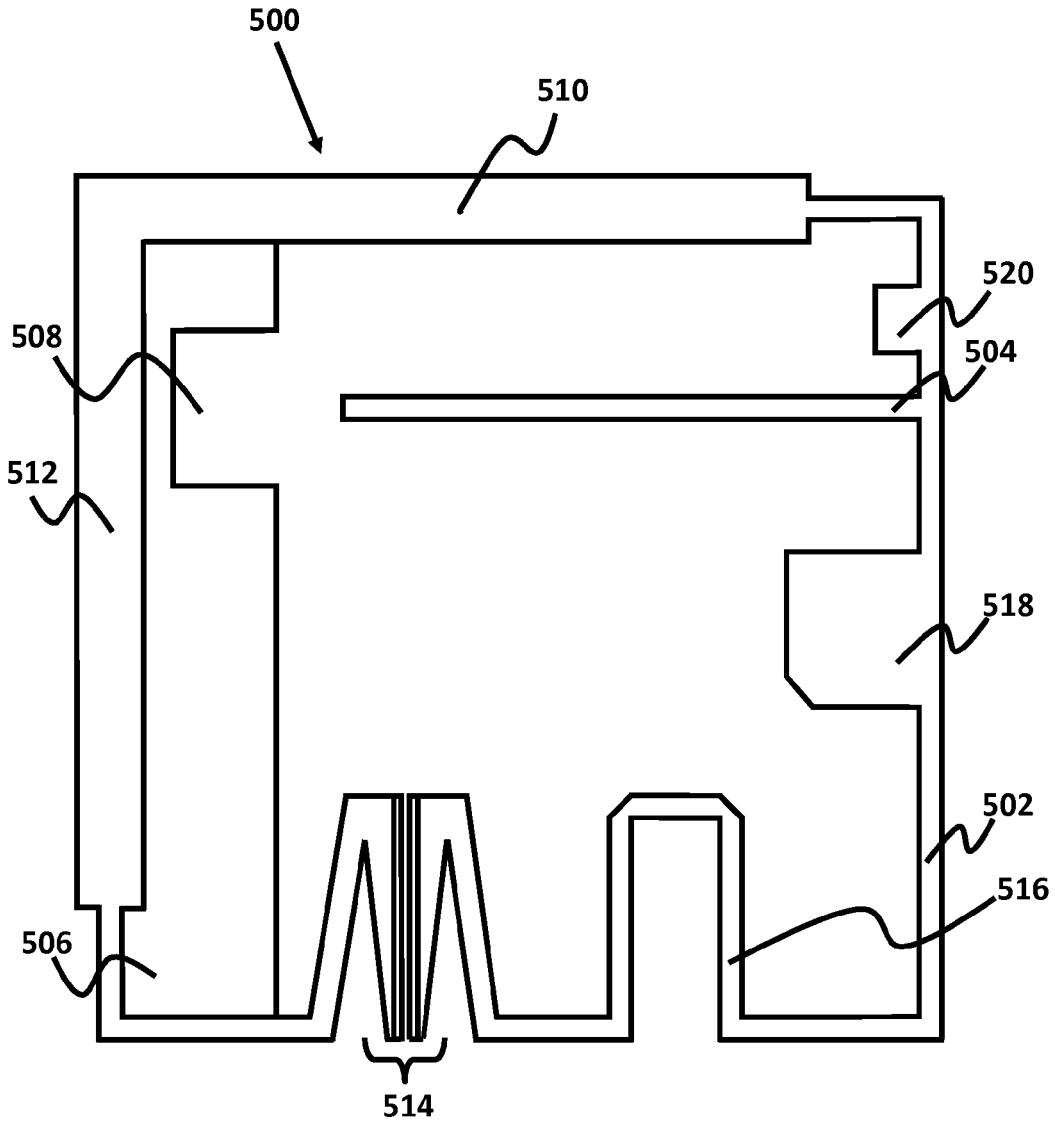
FIG. 5 is a plan view of one side of an embodiment of a double-sided 402 MHz self-contained, circular polarized, compound loop antenna using one electric field radiator, a patch on the back side of the antenna acting as the second electric field radiator, and a combination of delay loops and delay stubs.

FIG. 5 illustrates another embodiment of a double-sided, 402 MHz, self-contained, circular polarized, CPL antenna 500. In contrast to the other antennas presented thus far, the antenna 500 consists of a magnetic loop 502 and only one electric field radiator 504. Rather than using a second electric field radiator, the antenna 500 uses a large metal back patch 506 on the back of the antenna 500 as a parasitic, vertical electric field radiator. The back patch 506 has a substantially rectangular, cut out portion 508, which was cut from the back patch 506 to reduce the capacitive coupling between the electric field radiator 504 and the back patch 506. The cut out portion 508 does not affect the radiation pattern emitted by the back patch 506. The antenna 500 also includes a transition 510, a counterpoise 512, and a balun 514.

In particular, the antenna 500 illustrates the use of a combination of delay loops, delay stubs, and metal patches to adjust the delay between the electric field radiator 504 and the back patch 506. The delay loop 516 does not radiate and is used to adjust the delay between the electric field radiator 504 and the back patch 506. The delay loop 516 also has its corners cut off at an angle. As mentioned above, cutting the corners at an angle can improve the flow of current around corners.

The antenna 500 also includes a metal patch 518 that is directly coupled to the magnetic loop 502, and a smaller delay stub 520, also directly coupled to the magnetic loop 502. Both the metal patch 518 and the delay stub 520 help tune the delay between the electric field radiator 504 and the back patch 506, acting as the vertical radiator. The metal patch 518 has its bottom left corner cut off to reduce the capacitive coupling between the metal patch 518 and the delay loop 516.

The back patch 506, even though it is parasitic, is positioned along a direction orthogonal to the electric field radiator 504. For instance, if the electric field radiator 504 is oriented at an angle and coupled to the magnetic loop 502 via an electrical trace, then the back patch 506 would have to be oriented such that the difference in the orientation between the electric field radiator 504 and the back patch 506 is 90 degrees.

Figure 6:
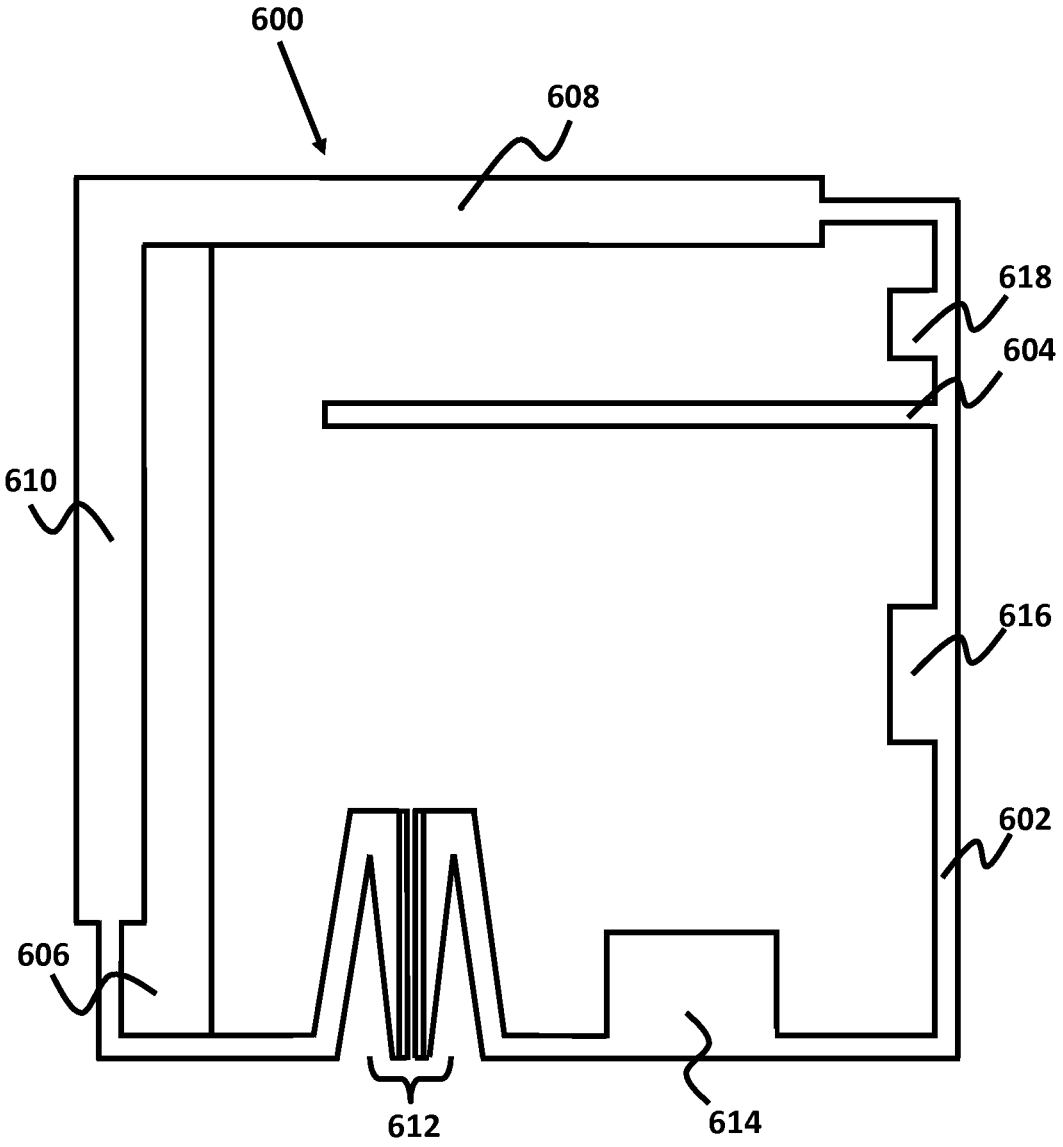
FIG. 6 is a plan view of one side of an embodiment of a double-sided 402 MHz self-contained, circular polarized, compound loop antenna using three delay stubs to adjust the delay between an electric field radiator and a back patch on the back of the antenna acting as the second electric field radiator.

FIG. 6 illustrates another example of a double-sided, 402 MHz, self-contained, circular polarized CPL antenna 600. The antenna 600 consists of a magnetic loop 602, an electric field radiator 604, a back patch 606 acting as the second parasitic radiator orthogonal to the electric field radiator 604, a transition 608, a counterpoise 610, and a balun 612. FIG. 6 is an example of an antenna 600 which only uses delay stubs to adjust the delay between the electric field radiator 604 and the back patch 606. The back patch 606 is located on the back side of the antenna 600. The back patch 606 spans the entire length of the left side of the magnetic loop 602. The back patch 606 does not have a portion cut out, as was the case for back patch 506 from FIG. 5, because the back patch 606 is narrower.

Antenna 600 makes use of three delay stubs to adjust the delay between the electric field radiator 604 and the back patch 606. FIG. 6 includes a large delay stub 614 positioned to the right of the balun 612, a medium delay stub 616 positioned along the right side of the magnetic loop 602 and before the electric field radiator 604, and a small delay stub 618 also positioned along the right side of the magnetic loop 602, but after the electric field radiator 604.

As noted above, a self-contained, circular polarized CPL antenna can use only delay loops, only delay stubs, or a combination of delay loops and delay stubs to adjust the delay between the two electric field radiators or between the electric field radiator and the other element acting as the second electric field radiator. An antenna can use one or more delay loops of various sizes. In addition, some of the delay loops can have their corners cut off at an angle to improve the flow of current along the corners of the delay loops. Similarly, an antenna can use one or more delay stubs of various sizes. The delay stubs can also be shaped or cut accordingly to reduce capacitive coupling with other elements in the antenna. Finally, both the delay loops and the delay stubs can be physically located on the inside of the magnetic loop, such that they protrude into the magnetic loop. Alternatively, the delay loops and the delay stubs can be physically located on the outside of the magnetic loop, such that they protrude out of the magnetic loop. A single antenna can also combine one or more delay loops/stubs that protrude into the magnetic loop and one or more delay loops/stubs that protrude out of the magnetic loop. The delay loops can have various shapes, ranging from a substantially rectangular shape to a substantially smooth curved shape.

Figure 7:
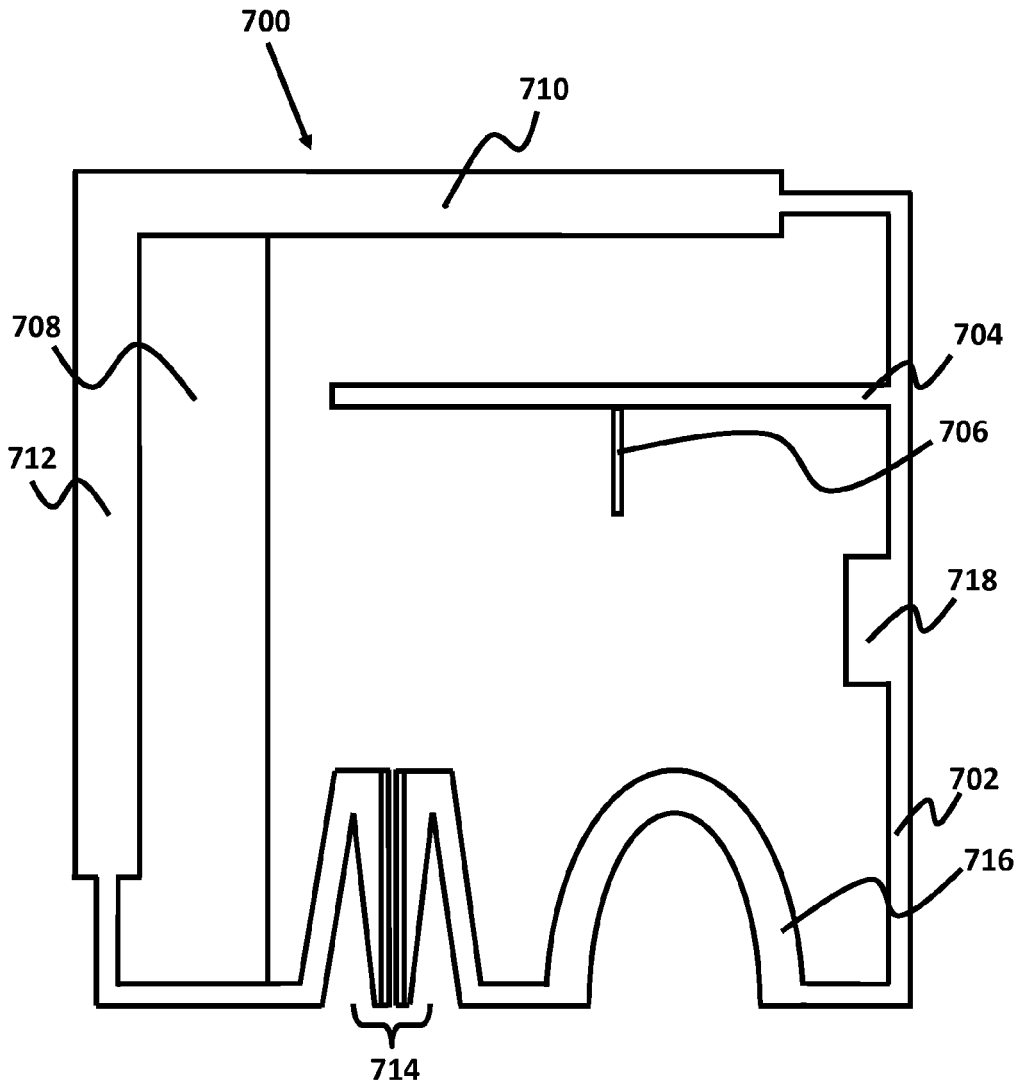
FIG. 7 is a plan view of one side of an embodiment of a double-sided 402 MHz self-contained, circular polarized, compound loop antenna having an electric field radiator with an orthogonal trace electrically lengthening the electric field radiator, a back patch on the back of the antenna acting as the second electric field radiator, a delay loop being substantially arch shaped, and a delay stub.

FIG. 7 illustrates another example of a double-sided, 402 MHz, self-contained, circular polarized CPL antenna 700. The antenna 700 includes a magnetic loop 702, an electric field radiator 704 having a small trace 706 located in the middle of the electric field radiator 704, a back patch 708 acting as the parasitic electric field radiator orthogonal to the electric field radiator 704, a transition 710, a counterpoise 712, and a balun 714. The small trace 702 is positioned orthogonal to the electric field radiator 704 and serves the purpose of electrically lengthening the electric field radiator 704 for impedance tuning. Hence, rather than making the electric field radiator 704 longer and having to cut out a portion of the back patch 708 to prevent capacitive coupling between these two elements, a small trace 706 orthogonal to the electric field radiator 704 lengthens the electric field radiator 704 without having to make the electric field radiator physically longer.

The antenna 700 is an example of an antenna that uses a delay loop having a substantially smooth curved shape. The delay loop 716 is substantially arch shaped. However, it is noted that the use of a rectangular shaped delay loop increases the antenna performance compared to the use of arch shaped loop as illustrated in FIG. 7.

The antenna 700 also includes a delay stub 718 that is substantially rectangular shaped. Both the delay loop 716 and the delay stub 718 are used to adjust the delay between the horizontal electric field radiator 704 and the vertical back patch 708 acting as the second electric field radiator.

In each embodiment of the antennas illustrated above, the magnetic loop, as a whole, has a first inductive reactance and that first inductive reactance must match the combined capacitive reactance of the other components of the antenna, such as the first capacitive reactance of the first electric field radiator, the second capacitive reactance of the physical arrangement between the first electric field radiator and the magnetic loop, the third capacitive reactance of the second electric field radiator, and the fourth capacitive reactance of the physical arrangement between the second electric field radiator and the magnetic loop. Likewise it is to be understood that other elements may contribute inductive reactance and capacitive reactance that must be matched or balanced throughout the antenna for proper performance.

Figure 8A:
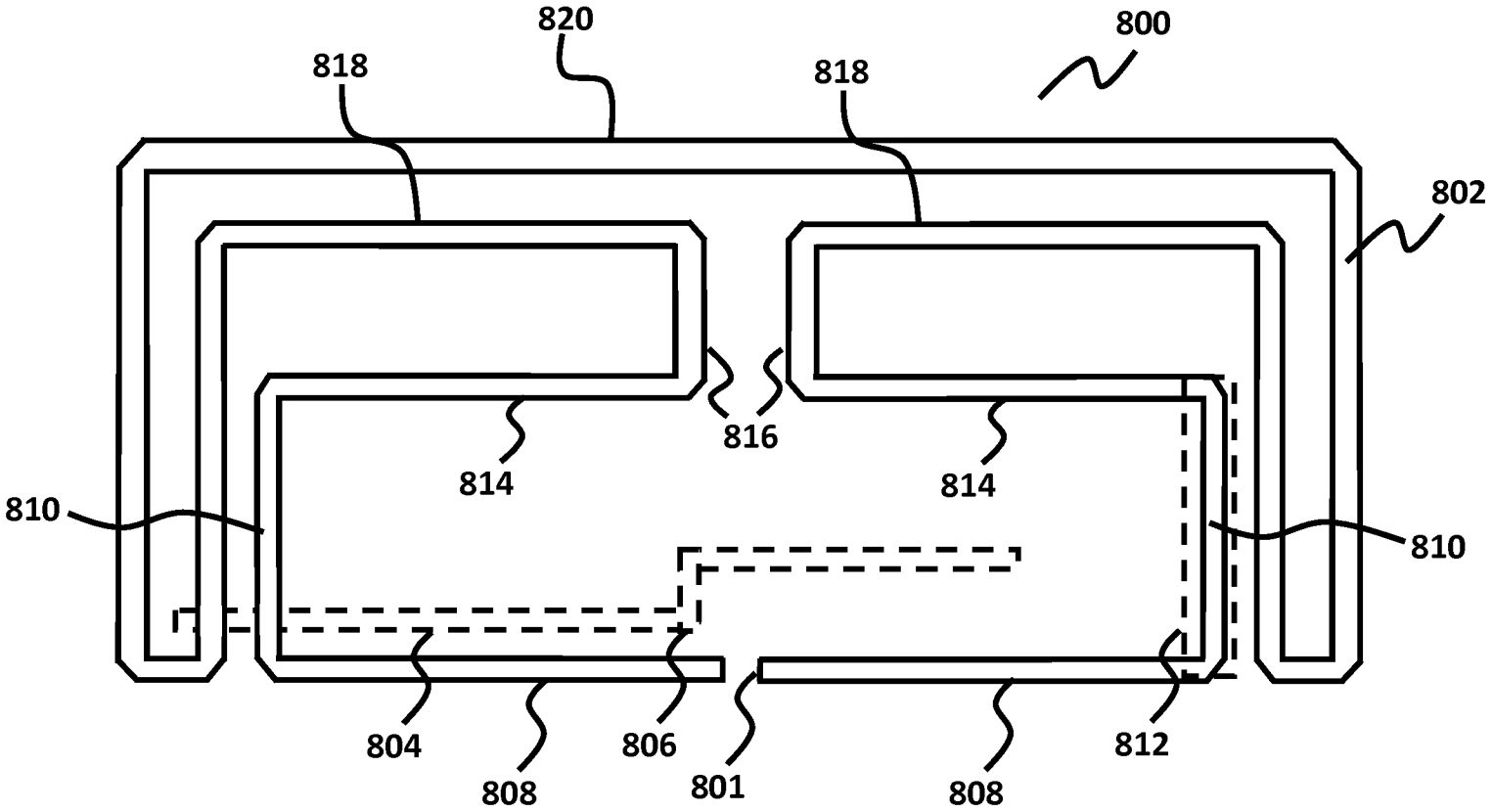
FIG. 8A is a plan view of an embodiment of a double-sided 700 MHz-2100 Mhz multi-band antenna illustrating the parasitic radiator and capacitive patch on the back plane of the antenna.

FIG. 8A illustrates an embodiment of a double-sided (multi-layered) multi-band CPL antenna with a parasitic radiator. The antenna 800 has a length of approximately 5.08 cm and a height of approximately 2.54 cm. The antenna 800 includes a magnetic loop trace 802 on a top plane and a parasitic electric field radiator 804 (parasitic radiator) on the bottom plane. The magnetic loop of the trace 802 is a full wavelength, however alternative embodiments of the trace 802 can have different wavelengths. The trace 802 also operates as an electric field radiator at two more different frequencies, as more fully described below. As with the other CPL antennas described above, each of the electric fields is orthogonal to each of the magnetic fields of the magnetic loop 802.

The electric field radiator 804 is referred to as a parasitic radiator because it is not physically connected to the magnetic loop 802 and because it is resonant to something that is energizing it. A resonant element is an element that is absorbing energy and reradiating energy 180 degrees out of phase with the energy that it is absorbing. As long as the element is constantly excited with energy, the energy in the element builds up to twice the energy that is absorbed. To radiate twice the energy that an element is absorbing, the total energy cannot be greater than 3 db over all of the energy that is excited.

The parasitic radiator 804 emits an electric field. It is important for the present embodiment of the antenna to have the electric fields generated by the magnetic loop 802, due to the presence of the parasitic radiator 804, to also be located on locations along the magnetic loop that are parallel to the parasitic radiator 804. In addition, the electric fields generated by the magnetic loop trace 802 also need to be in phase with the electric field emitted by the parasitic radiator 804.

The parasitic radiator 804 includes a bend or zig-zag 806, even though an electric field radiator 804 that is straight results in the highest efficiency and gain. Whenever a bend, such as bend 806, is introduced, it results in some canceling of the electric field emitted by the electric field radiator. In the embodiment illustrated in FIG. 8, a straight electric field radiator without a bend would have resulted in capacitive coupling between the feed or drive point 801 of the magnetic loop and the electric field radiator. This capacitive coupling would in turn have made the magnetic loop 802 a resonant circuit due to the magnetic loop 802 being an inductor in parallel to the capacitor. It is desirable to have the parasitic radiator 804 be the resonant element rather than the magnetic loop 802, so that the parasitic radiator 804 can be used to set the desired frequency.

The parasitic radiator 804 depicted in FIG. 8 is positioned on the inside of the magnetic loop 802. In alternative embodiments, the parasitic radiator 804 can be positioned such that more than half of the parasitic radiator 804 is on the inside of the magnetic loop 802. Moving the parasitic radiator 804, along the back plane or bottom layer, closer to the center of the magnetic loop 802, decreases the electrical length of the parasitic radiator 804. Conversely, moving the parasitic radiator 804 closer to the edges of the magnetic loop 802 increases the electrical length of the parasitic radiator 804.

The magnetic loop 802 trace is bent into one or more horizontal sections and one or more vertical sections. The magnetic loop trace 802 illustrated in FIG. 8 is symmetric, with the right half of the trace being identical to the left half of the trace. However, the trace 802 is only a particular embodiment of the plurality of ways in which a magnetic loop trace 802 can be arranged and folded to form various horizontal sections and vertical sections that radiate electric fields at various frequencies. In alternative embodiments, an antenna can use a magnetic loop trace that is asymmetric, with the right half of the trace being folded into a pattern different than the pattern of the left half of the trace.

For ease of understanding, the magnetic loop trace 802 will be further described with reference to the right half of the magnetic loop trace, starting from the drive point 801. The magnetic loop trace 802 consists of a first horizontal section 808 that radiates a first electric field. The first horizontal section 808 bends at a substantially 90 degree angle to a first vertical section 810 which reinforces the first horizontal section 808. The first vertical section 810 bends at a substantially 90 degree angle to a second horizontal section 814 radiating a second electric field. The second horizontal section 814 bends at a substantially 90 degree angle to a second vertical section 816, which capacitively cancels the corresponding second vertical section on the left half of the magnetic loop 802. The second vertical section 816 bends at a substantially 90 degree angle to a third horizontal section 818 that radiates a third electric field. Finally, the top trace 820 of the magnetic loop trace 802 radiates in phase with the first horizontal section 808, and both the top trace 820 and the first horizontal section 808 are reinforced by the parasitic radiator 804.

The various horizontal sections of the magnetic loop trace that radiate the electric fields can be moved around as necessary to make the electric fields more or less additive. The antenna 800 further includes a capacitive patch 812 on the back plane of the antenna 800 which adds capacitance to the first vertical section 810. In particular, the capacitive patch 812 allows the one or more electric fields generated by the antenna 800 to be more in phase with each other, and consequently be additive and not subtractive. Thus, the capacitive patch 812 is an example of a way of tuning the antenna and, in particular, tuning the electric fields generated by the antenna.

It is to be understood that the capacitive patch 812 is not required for the antenna 800 to be tuned properly. While one embodiment can use the capacitive patch 812 to tune the performance of the antenna, the benefits of adding the capacitive patch 812 can also be achieved by adjusting the magnetic loop trace. The magnetic loop trace can be adjusted by increasing or decreasing the size of the top trace 820, by increasing or decreasing the overall width of the magnetic loop trace, making one or more sections of the magnetic loop trace 802 wider or narrower than the overall magnetic loop trace 802, adjusting the position of the bends in the magnetic loop trace 802, etc. Similarly, an embodiment of an antenna 800 can use two or more capacitive patches positioned at various positions relative to sections of the magnetic loop trace 802 in order to tune the antenna performance.

The first horizontal section 808 of the magnetic loop trace 802 is a quarter wavelength, even though in alternative embodiments the first horizontal section 808 can have a different length that is a multiple of a wavelength. The first vertical section 810 of the magnetic loop trace 802 is for reinforcement and it acts as a capacitor sitting at the end of a quarter-wave monopole. As indicated above, the capacitive tuning patch 812 adjusts the capacitance of the first vertical section 810 of the magnetic loop trace 802, and consequently shortens the wavelength set by the first horizontal section 808. The second horizontal section 814 of the magnetic loop trace 802 cancels the capacitance added by the first vertical section 810, in addition to radiating a second frequency band.

In the antenna 800, the capacitive patch 812 does not behave as an electric field radiator because it is orthogonal to the electric fields generated by the horizontal sections of the magnetic loop trace 802. The parasitic radiator 804 is aligned along the same plane as the horizontal sections of the magnetic loop trace 802, and consequently it behaves as a parasitic element and not as a capacitive patch. The energy reradiated by the parasitic radiator 804 is parallel to the electric fields generated by the horizontal sections of the magnetic loop trace 802.

The length of the parasitic radiator 804 is set based on the resonant frequency desired to be radiated by the parasitic radiator 804. It is also to be understood that frequency is logarithmic. Therefore, as frequency doubles, there is a loss of 6 dB in path attenuation and performance. In order for the antenna 800 to operate efficiently, the length of the parasitic radiator 804 is set to the lowest frequency to be generated by the antenna 800 to add 3 dB to the efficiency of the antenna 808 at the lowest frequency. In alternative embodiments, the length of the parasitic radiator 802 can be set to a particular frequency among the plurality of frequencies generated by the antenna 800 based on the tuning of the desired antenna performance.

The antenna 800 operates at 700 MHz, 1200 MHz and 1700 MHz to 2100 MHz. The first horizontal section 808 of the magnetic loop trace 802 (which is a YAGI element) combined with the top trace 820 of the magnetic loop trace 802, and reinforced by the parasitic radiator 804, generate the 700 MHz frequency band. The third horizontal section 818 generates the 1200 MHz frequency band. The second horizontal section 814 generates the 1700 MHz to 2100 MHz frequency band. The second horizontal section 814 is able to generate the range between 1700 MHz to 2100 MHz due to the loading capacitor 812 on the back plane of the antenna 800. The entire outer rectangular outline of the magnetic loop 802 is the magnetic component for the 700 MHz frequency band. As can be appreciated from the antenna embodiment 800, the sections generating the various frequency bands do not have to be in a particular order in the magnetic loop 802.

As noted above, in the antenna 800, parts of the magnetic loop trace 802 are canceled off in order to make the overall length of the magnetic loop trace 802 a full wavelength. The shape of the magnetic loop trace 802 enables the antenna to generate various frequencies, but to create the various bends that result in the horizontal and vertical sections of the magnetic loop trace 802, a magnetic loop with a length of greater than one wavelength is used. For example, the second vertical sections 816 cancel off each other. This enables the magnetic loop trace 802 to behave as if its electrical length is one wavelength, even if the physical length of the magnetic loop trace 802 is longer or shorter than one wavelength.

Figure 8B:
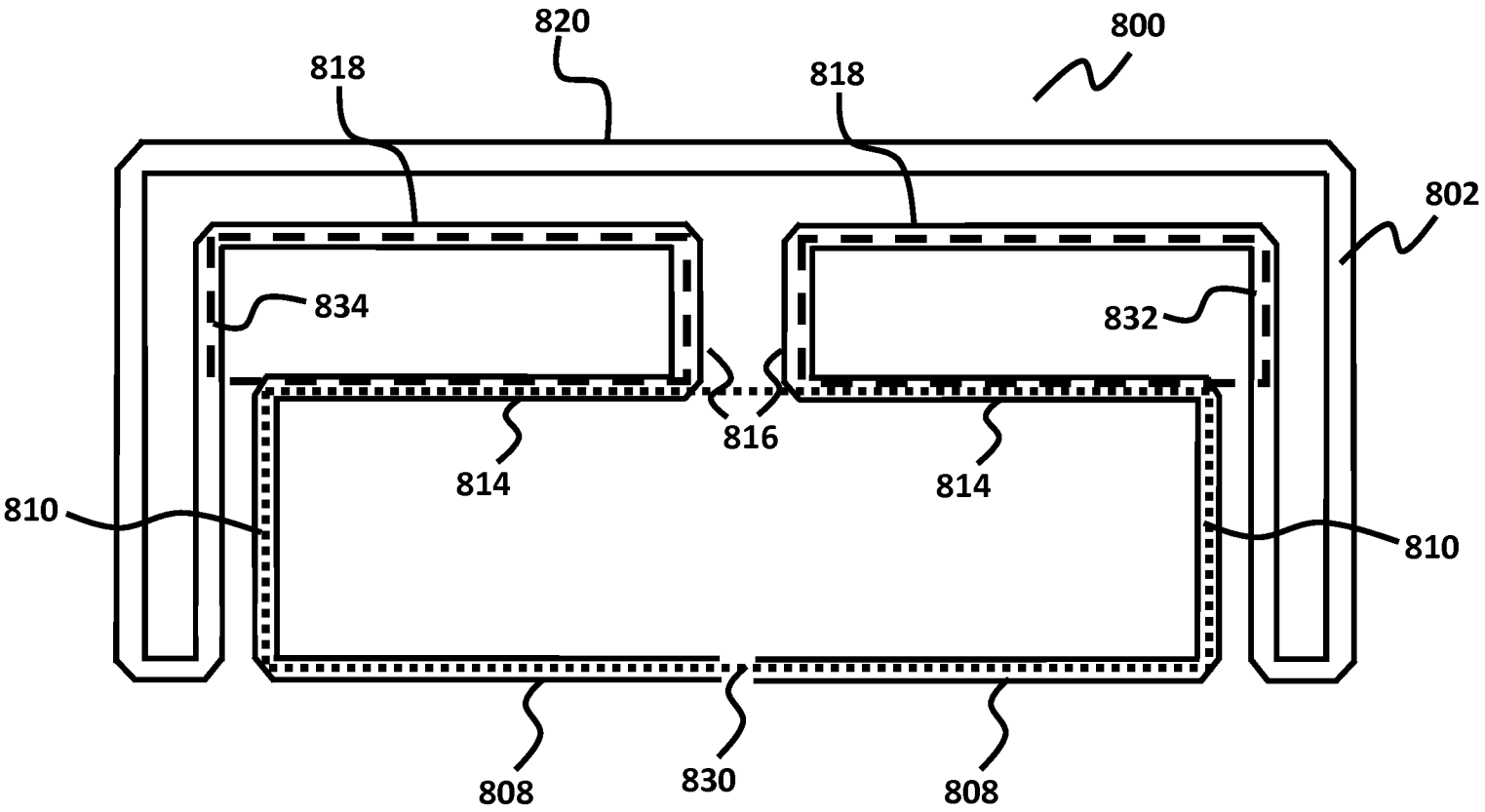
FIG. 8B is a plan view of the multi-band antenna illustrated in FIG. 8B further illustrating the magnetic loops formed in the multi-band antenna.

The bending of the magnetic loop trace 802, along with the use of cancellation and reinforcement at various points of the magnetic loop trace 802, enables the single magnetic loop trace 802 to behave as a plurality of magnetic loops of various dimensions. As illustrated in FIG. 8B, a first magnetic loop 830 is formed by the first horizontal section 808, the first vertical section 810, and the second horizontal section 814. A second magnetic loop is formed by the entire trace 802 of the magnetic loop. Finally, a third magnetic loop 832 and a fourth magnetic loop 834 are formed by the second horizontal section 814, the second vertical section 816, and the third horizontal section 818. However, the third and fourth magnetic loops 832 and 834 do not generate any gain or efficiency, as the spacing and arrangement of these magnetic loops results in these two magnetic loops canceling each other. It is further to be understood that the magnetic loop trace 802 is bent in such a form as to enable the various nodes of high voltage and the various nodes of high current that flow through the magnetic loop to be additive at the particular frequencies that the multi-band antenna is to generate.

Figure 9A:
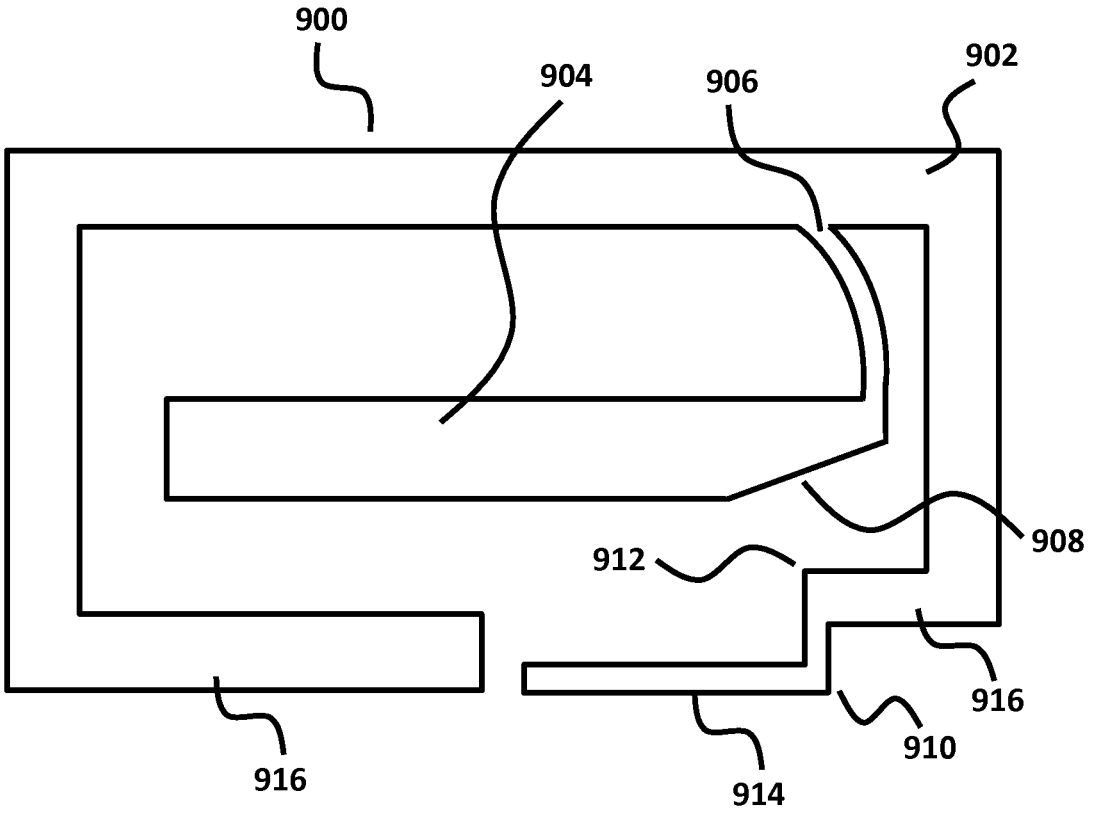
FIG. 9A is a plan view of an embodiment of a 2.4 GHz/5.8 GHz multi-band antenna having an electric field radiator and a monopole formed out of the magnetic loop generating the two frequency bands.

Alternative embodiments comprise a CPL antenna that can generate multiple frequency bands without a parasitic radiator. This is achieved by having at least one electric field radiator, positioned within the magnetic loop, generating a first frequency band, and by having various portions of the magnetic loop radiate, in combination or independently of the electric field radiator, at various frequencies to generate the additional frequency bands. FIG. 9A illustrates an embodiment of a 2.4/5.8 GHz multiband CPL antenna 900. The antenna 900 is an example of an antenna having a width of approximately 1 centimeter and a length of approximately 1.7 centimeters. The antenna 900 includes a magnetic loop 902 and an electric field radiator 904 positioned on the inside of the magnetic loop 902. The electric field radiator 904 is used to generate the first band (2.4 GHz) of the antenna 900. The electric field radiator 904 is coupled to the magnetic loop 902 via a meandering trace 906. The trace 906 couples the electric field radiator 904 at the 90 degree phase point, even though it may alternatively be coupled at the 180 or 270 degree phase point, or at a point along the magnetic loop 902 where a current flowing through the magnetic loop 902 is at a reflective minimum. The electric field radiator 904 can also be directly coupled to the magnetic loop 902, depending on the antenna design or the required dimensions for the antenna. For instance, in the antenna 900, because the electric field radiator is coupled to the top of the magnetic loop 902, it is difficult to directly couple the electric field radiator 904 to the magnetic loop 902; hence the need for the trace 906, but different designs could enable the electric field radiator to couple to a side of the magnetic loop 902.

In the antenna 900, a portion of the magnetic loop is bent in a substantially stair-shaped manner at the bend 910 to create a monopole 914. Specifically, the portion 916 of the magnetic loop after the bend 910 is capacitively loaded to bring the monopole 914 into resonance. The monopole 914 generates the higher frequency band, 5.8 GHz, of the antenna 900.

The electric field radiator 904 is substantially rectangular shaped. The bottom right corner 908 of the electric field radiator 904 is cut at an angle to reduce the capacitive coupling between the bottom right corner 908 of the electric field radiator 904 and the bend 910, especially the corner 912 of the bend 910 which is nearest to the electric field radiator 904. Cutting the corner of the electric field radiator 904 is optional and can be used in various embodiments depending on the desired antenna performance and other antenna requirements. In alternative embodiments, one or more corners of the electric field radiator 904 can be cut at an angle to reduce capacitive coupling with one or more portions of the magnetic loop, including portions of the magnetic loop where there is not a bend 910 or a monopole 914.

Cutting the corner of the electric field radiator 904 at an angle changes the pattern and the resonant frequency of the electric field radiator 904. In the embodiment illustrated in FIG. 9A, it was desirable to maximize efficiency at the higher band frequency. Thus, even though cutting the corner of the electric field radiator at an angle affects its performance, this was preferable to having the corner of the electric field radiator capacitively coupled to the bend of the higher frequency band.

The electrical trace 906 can be shaped in other ways, such as being straight instead of curvy. The electrical trace 906 can also be shaped with soft and graceful curves, as illustrated in FIG. 9A, or shaped to minimize the number of bends in the electrical trace 906. In addition, the electrical trace 906 can be varied by increasing or decreasing its thickness in order for the inductance of the electrical trace to match the overall capacitance reactance of the various elements and portions of the antenna and the overall inductive reactance generated by the various elements and portions of the antenna. The electrical trace 906 also adds electrical length to the electric field radiator 904.

Figure 9B:
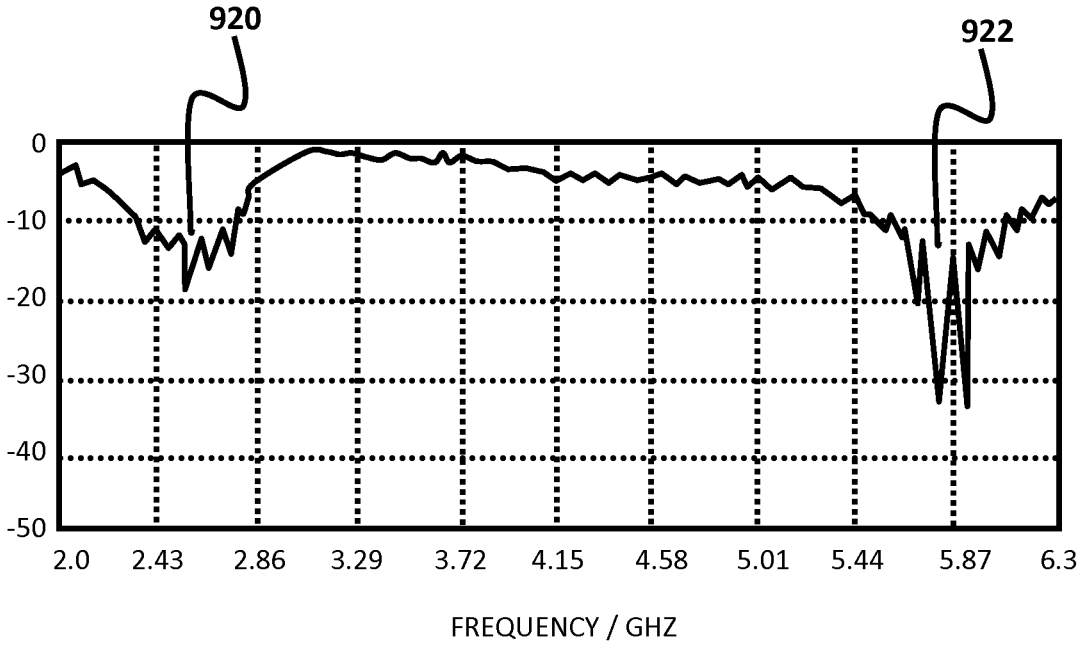
FIG. 9B illustrates the return loss for the 2.4 GHz/5.8 GHz multi-band antenna from FIG. 9A.

FIG. 9B illustrates a return loss diagram for the antenna 900. The return loss diagram shows a first dip 920 associated with the lower frequency band and a second dip 922 associated with the higher frequency band of the antenna. The return loss diagram illustrates energy that was emitted by the antenna 900 and that did not return from the antenna to the transmitter. Thus, at the two frequency bands of the antenna (2.4 GHz and 5.8 GHz), there are two corresponding return loss dips 920 and 922.

In addition, the two dips in the return loss can be moved independently of each other. Thus, the two frequency bands can be adjusted independently, as they are independent resonances. Embodiments of the multi-band antenna can generate frequencies that are not harmonically related without the parasitic effect deterring from the antenna performance. It is also to be understood that the antenna 900 has a single feed point, yet is able to generate two or more frequency bands that are not harmonically related.

As noted above, the frequency bands can be adjusted independently. For instance, the electric field radiator 904 can be adjusted by changing its width or its height, and these changes would have no effect on the frequency band associated with the bend 910. The monopole 914 from the bend 910 can be adjusted in frequency by adjusting left or right the right angle adjacent to the monopole. Moving the right angle adjacent to the monopole to the right would result in a longer monopole, resulting in a lower frequency being emitted by the monopole 914. On the other hand, moving the right angle adjacent to the monopole to the left would result in a shorter monopole, resulting in a higher frequency being emitted by the monopole 914. As previously noted, having a shorter monopole would result in smaller wavelengths, which are higher in frequency. Conversely, having a longer monopole would result in longer wavelengths, which are lower in frequency.

Figure 10:
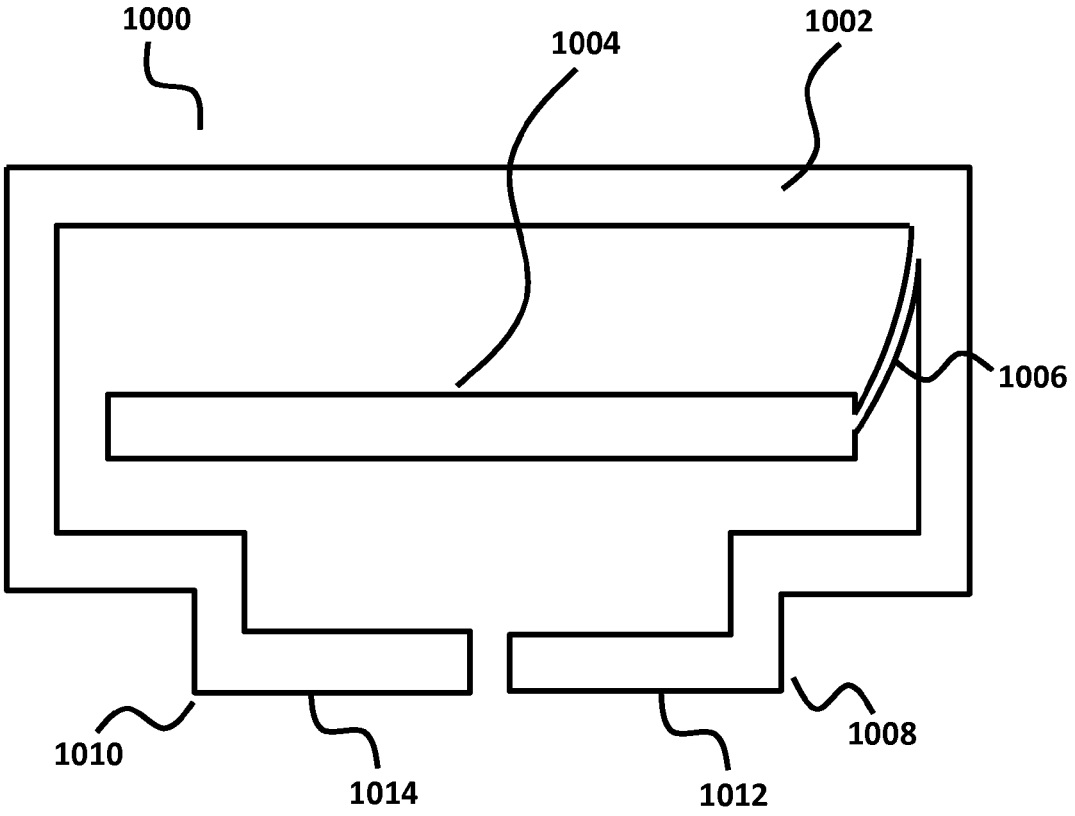
FIG. 10 is a plan view of an embodiment of a 2.4 GHz/5.8 GHz multi-band antenna having an electric field radiator and a dipole formed out of the magnetic loop generating the two frequency bands.

The electric field radiator 904 and the monopole 914 in the bend 910 are monopoles because half of the dipole is gone (the converse of which is illustrated with respect to FIG. 10). It would be a dipole if the other half was a counterpoise for the monopole. In antenna 900, the monopole 914 in the bend 910 is riding on a counterpoise, with the counterpoise being the opposite side of the magnetic loop.

FIG. 10 illustrates yet another embodiment of a 2.4/5.8 GHz antenna 1000 that uses a dipole to generate the 5.8 GHz band of the antenna. The antenna 1000 is comprised of a magnetic loop 1002 and an electric field radiator 1004 coupled to the magnetic loop 1002 via a meandering trace 1006. The electric field radiator 1004 is substantially rectangular shaped, but it does not have its bottom right corner, or any other corner, cut off at an angle. Thus, this is meant to show that embodiments of antennas may or may not have electric field radiators with corners cut off at an angle to reduce capacitive coupling with other elements of the antenna.

In general, if the elements of an antenna are arranged in a particular fashion, then the antenna can be tuned by cutting off corners of one or more elements in order to reduce capacitive coupling between elements that are close to each other. However, the total surface area of the electric field radiator affects the efficiency. Thus, cutting a corner of the electric field radiator lowers the efficiency of the antenna. The second right angle affects the size of the magnetic loop. The minimum reflective current points would move as a consequence as well.

The antenna 1000 includes a first bend 1008 and a portion that is bent with a second stair-shaped bend 1010, with the first stair-shaped bend 1008 being substantially symmetric to the second bend 1010. The first quarter wavelength dimension 1012 together with the second quarter wavelength dimension 1014 form a dipole. The use of dipole over a monopole is based on the desired angle of radiation and impedance bandwidth required.

Figure 11A:
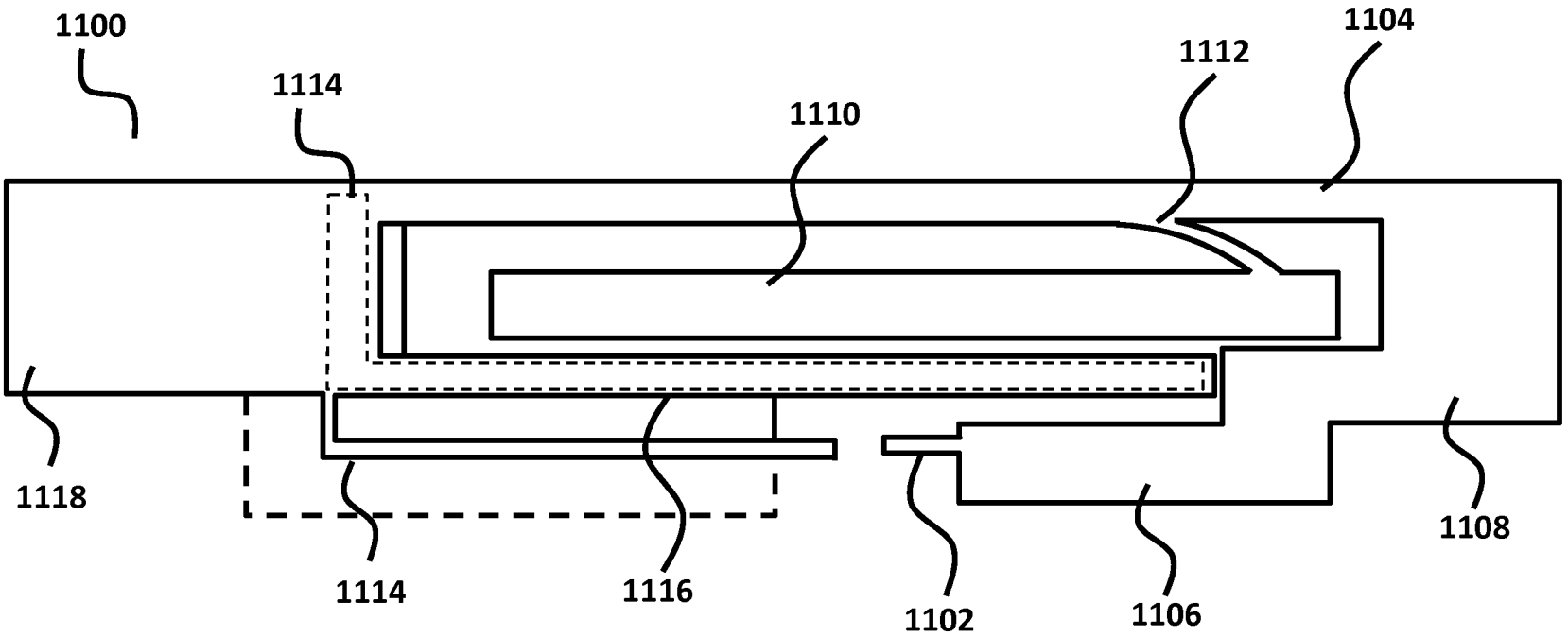
FIGS. 11A and 11B are a plan view of the top plane and the bottom plane of an embodiment of a primary LTE antenna.

FIG. 11A illustrates an embodiment of a primary Long Term Evolution (LTE) antenna 1100. The LTE antenna 1100 covers a first frequency range of 698 MHz-798 MHz, a second frequency range of 824 MHz-894 MHz, a third frequency range of 880 MHz-960 MHz, a fourth frequency range of 1710 MHz-1880 MHz, a fifth frequency range of 1850 MHz-1990 MHz, and a sixth frequency range of 1920 MHz-2170 MHz. The antenna 1100 has a length of approximately 7.44 centimeters and a height of approximately 1 centimeter. The antenna 1100 is comprised of a top plane illustrated in FIG. 11A, and a back plane illustrated in FIG. 11B.

Antenna 1100 is comprised of a single feed point 1102. The magnetic loop 1104 is bent to form a monopole 1106, which acts as an electric field radiator. The monopole 1106 is the radiator for the 1800 MHz frequency. However, other elements of the antenna 1100 that radiate electric fields parallel to the electric field generated by the monopole 1106, improve the gain and efficiency of the electric field radiated by the monopole 1106. Thus, the electric field with the highest amplitude is emitted by the monopole 1106, while other elements of the antenna 1100 emit electric fields with a lower amplitude than the monopole 1106.

The center radiator 1110 is the monopole that emits the electric field with the greatest amplitude at the 915 MHz frequency band. The center radiator 1110 is coupled to the magnetic loop 1104 at the 90/270 degree location via a meandering trace 1112. Alternatively, the center radiator 1110 can be coupled to the magnetic loop 1104 at the minimum reflective current point. At the 915 MHz frequency band, elements of the antenna, such as the lower left portion of the magnetic loop may couple to the ground plane, and consequently radiate parallel electric fields that add to the gain and efficiency of the electric field with the highest amplitude.

The wideband properties of the antenna enable the 850 MHz frequency band to be radiated by the center radiator 1110. The L-shaped portion 1114 (denoted by the dashed line) of the magnetic loop 1104 enables the wideband properties that result in the 850 MHz frequency band. The L-shaped portion 1114 is comprised of the right side of the right wing of the magnetic loop 1104 combined with the lower center radiator 1116. Specifically, the 850 MHz frequency band is radiated when the L-shaped portion 1114 of the magnetic loop 1104 capacitively couples to the center radiator 1110. Thus, the L-shaped portion 1114 adds capacitance to the center radiator 1110.

Other parts of the antenna 1100 also help maximize the efficiency of the antenna 1100 for the various frequency bands. For instance, the lower left side 1118 of the magnetic loop 1104 also radiates over the 1800 MHz frequency band. In addition, the upper left corner of the bend which creates the monopole 1106 and the right portion of the lower center radiator 1116 also radiate over the 1800 MHz frequency band. The upper left corner of the center radiator 1110 and the left lower side 1118 of the magnetic loop 1104 may also radiate over the 1800 MHz frequency band, increasing the gain efficiency at this particular band. When one or more elements of the antenna radiate in parallel and in phase, their respective gain is additive, increasing the overall radiating efficiency of the antenna. It is to be understood that embodiments are not limited to having elements radiated in the specific manner as that described herein. As noted above, variations in the design of an antenna may result in different antenna elements radiating with various intensities. For example, reducing the width of the center radiator 1110 may result in the center radiator not radiating for the 1800 MHz frequency band, or instead radiating but at a lesser intensity.

The first monopole 1106 and the lower left side 1118 of the magnetic loop 1104 are the main radiating elements over the 1900 MHz frequency band. As noted above, the arrangement of the antenna 1100 enables various elements of the antenna 1100 to radiate over various frequency bands, and thus improve the overall radiating efficiency over the various frequency bands. In this particular embodiment, the upper left corner of the center radiator, the right portion of the lower radiator, and the place between the center radiator and the top portion of the magnetic loop also radiate over the 1900 MHz frequency band.

At lower frequencies, the antenna may operate in an unbalanced mode, utilizing the application ground plane for radiation and improving the efficiency and gain. The monopole 1106 is the main radiating element that accounts for the 1800 MHz frequency band. Over the 2100 MHz frequency band, the main radiating elements are the lower left side 1118 of the magnetic loop 1104, the lower half of the first monopole 1106, the right portion of the lower electric field radiator 1116, the left portion of the center radiator 1110, and the space between the center radiator 1110 and the top of the magnetic loop 1104. Over the 750 MHz frequency band, the main radiating element is the lower electric field radiator 1116 and the lower half of the center radiator 1110. The lowest electric field radiator 1116 radiates at a higher intensity than the lower half of the center radiator 1110. Over the 850 MHz frequency band, the main radiating elements are the lower electric field radiator 1116 and the center radiator 1110. Over the 915 MHz frequency band, the main radiating elements are the lower electric field radiator 1116 and the center radiator 1110.

Figure 11B:
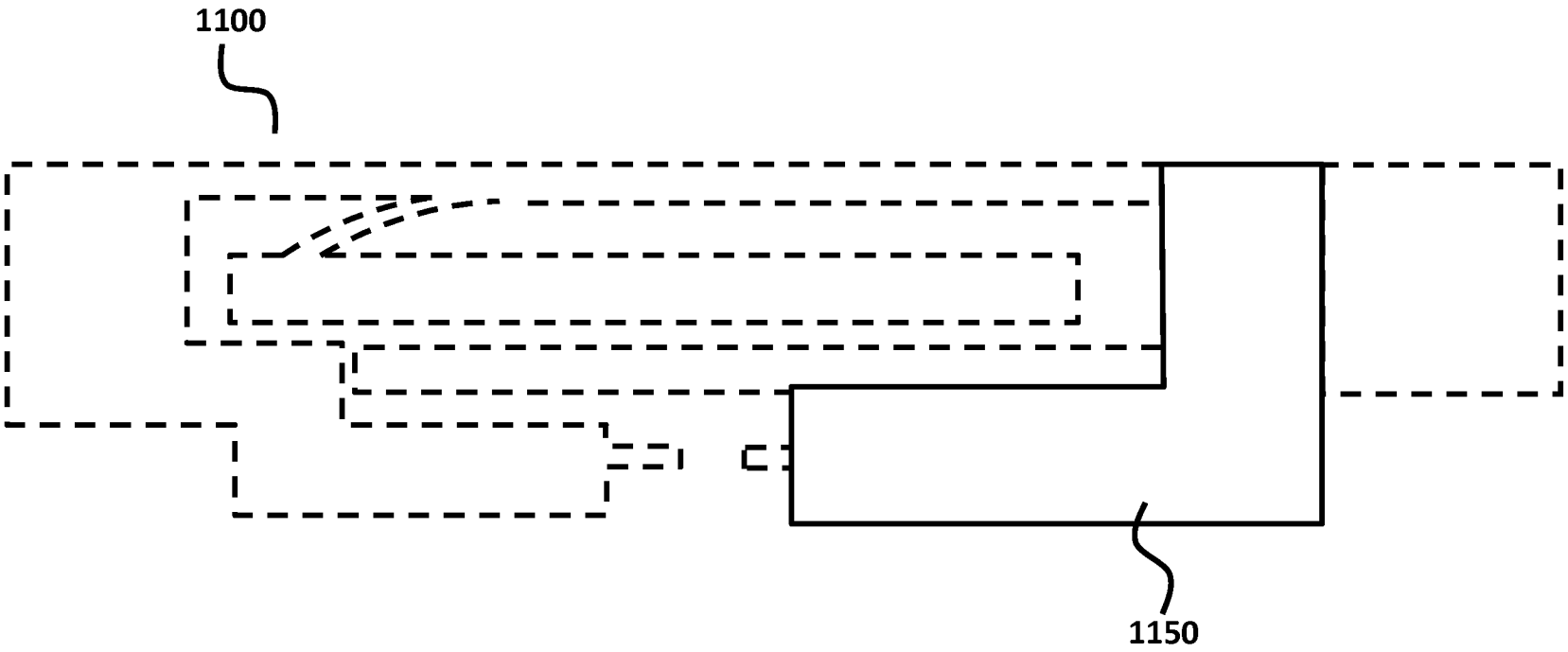

FIG. 11B illustrates the second layer of the antenna 1100. The antenna 1100 includes a loading capacitor 1150. The loading capacitor 1150 adds capacitance to account for the narrow trace of the magnetic loop on the lower left portion 1114 of the magnetic loop 1104. The dimensions of the loading capacitor 1150 can be increased or decreased as necessary to tune the overall capacitance of the antenna 1100.

It is to be understood that embodiments of the multi-band antenna can be implemented on semi or non-rigid substrate materials such as flexible circuit board, with a left portion of the left side of the magnetic loop and a right portion of the right side of the magnetic loop wrapped around a plastic component or some other component.

An embodiment is directed to a single-sided multi-band antenna, comprising a magnetic loop located on a plane and configured to generate a magnetic field, the magnetic loop including at least a first section and a second section, wherein the magnetic loop has a first inductive reactance adding to a total inductive reactance of the multi-band antenna; a monopole formed by a substantially stair-shaped bend of the magnetic loop, the monopole configured to emit a first electric field orthogonal to the magnetic field at a first frequency band; and an electric field radiator located on the plane and within the magnetic loop, the electric field radiator coupled to the magnetic loop and configured to emit a second electric field at a second frequency band orthogonal to the magnetic field, wherein the electric field radiator has a first capacitive reactance adding to a total capacitive reactance of the multi-band antenna, wherein a physical arrangement between the electric field radiator and the magnetic loop results in a second capacitive reactance adding to the total capacitive reactance, and wherein the total inductive reactance substantially matches the total capacitive reactance.

Yet another embodiment is directed to a multi-layered planar multi-band antenna, comprising a magnetic loop located on a first plane and configured to generate a magnetic field, the magnetic loop including a first section and a second section, wherein the magnetic loop has a first inductive reactance adding to a total inductive reactance of the multi-band antenna; a monopole formed by a substantially stair-shaped portion of the magnetic loop, the monopole configured to emit a first electric field orthogonal to the magnetic field at a first frequency band, and wherein one or more other portions of the magnetic loop resonate in phase with the monopole at the first frequency band; and an electric field radiator located on the first plane and within the magnetic loop, the first electric field radiator coupled to the magnetic loop and configured to emit a second electric field at a second frequency band, the second electric field emitted orthogonal to the magnetic field, wherein the electric field radiator has a first capacitive reactance adding to a total capacitive reactance of the multi-band antenna, wherein a physical arrangement between the electric field radiator and the magnetic loop results in a second capacitive reactance adding to the total capacitive reactance, wherein one or more second sections of the magnetic loop resonate in phase with the electric field radiator at the second frequency band, and wherein the total inductive reactance substantially matches the total capacitive reactance.

Yet another embodiment is directed to a multi-layered planar multi-band antenna, comprising a magnetic loop located on a first plane and configured to generate a magnetic field, the magnetic loop forming two or more horizontal sections and two or more vertical sections formed at substantially 90 degree angles between the two or more horizontal sections and the two or more vertical sections, a first horizontal section among the two or more horizontal sections emitting a first electric field at a low frequency band, a second horizontal section among the two or more horizontal sections emitting a second electric field at a high frequency band, wherein the magnetic loop has a first inductive reactance adding to a total inductive reactance of the multi-band antenna; and a parasitic electric field radiator located on a second plane below the first plane, at least half of the parasitic electric field radiator positioned on the second plane at a position that would place the electric field radiator within the magnetic loop if the position was on the first plane, the parasitic electric field radiator not coupled to the magnetic loop, the parasitic electric field radiator configured to emit a third electric field at the low frequency band that reinforces the first electric field and orthogonal to the magnetic field, wherein the parasitic electric field radiator has a first capacitive reactance adding to a total capacitive reactance of the multi-band antenna, wherein a physical arrangement between the electric field radiator and the magnetic loop results in a second capacitive reactance adding to the total capacitive reactance, and wherein the total inductive reactance substantially matches the total capacitive reactance.

In embodiments of antennas described herein, the total inductive reactance matches the total capacitive reactance, with various elements of the antenna contributing to the total inductive reactance of the antenna and other elements contributing to the total capacitive reactance of the antenna. For example, the magnetic loop of an antenna has an inductive reactance that adds to the total inductive reactance, the electric field radiator of the antenna has a capacitive reactance adding to the total capacitive reactance of the antenna, and so on. When the inductive reactance of the magnetic loop and the capacitive reactance of the electric field radiator match, it implies that the electric field radiator and the magnetic loop are both generating and re-enforcing each other at the same resonant frequencies.

Embodiments described herein also use a non-continuous loop structure to achieve greater magnetic energy and to allow the electric field radiator(s) to be additive to the overall efficiency of the antenna at the desired resonant frequencies. In a particular embodiment, when an antenna has two or more electric field radiators, at least one electric field radiator works at the same frequency as the main magnetic loop. This is referred to as the compound mode of the antenna. In the case of multi-band antennas (with and without a parasitic radiator), where various parts of the magnetic loop operate at different frequencies, there is also at least one electric field radiator which works at the same frequency as the main magnetic loop.

Figure 12:
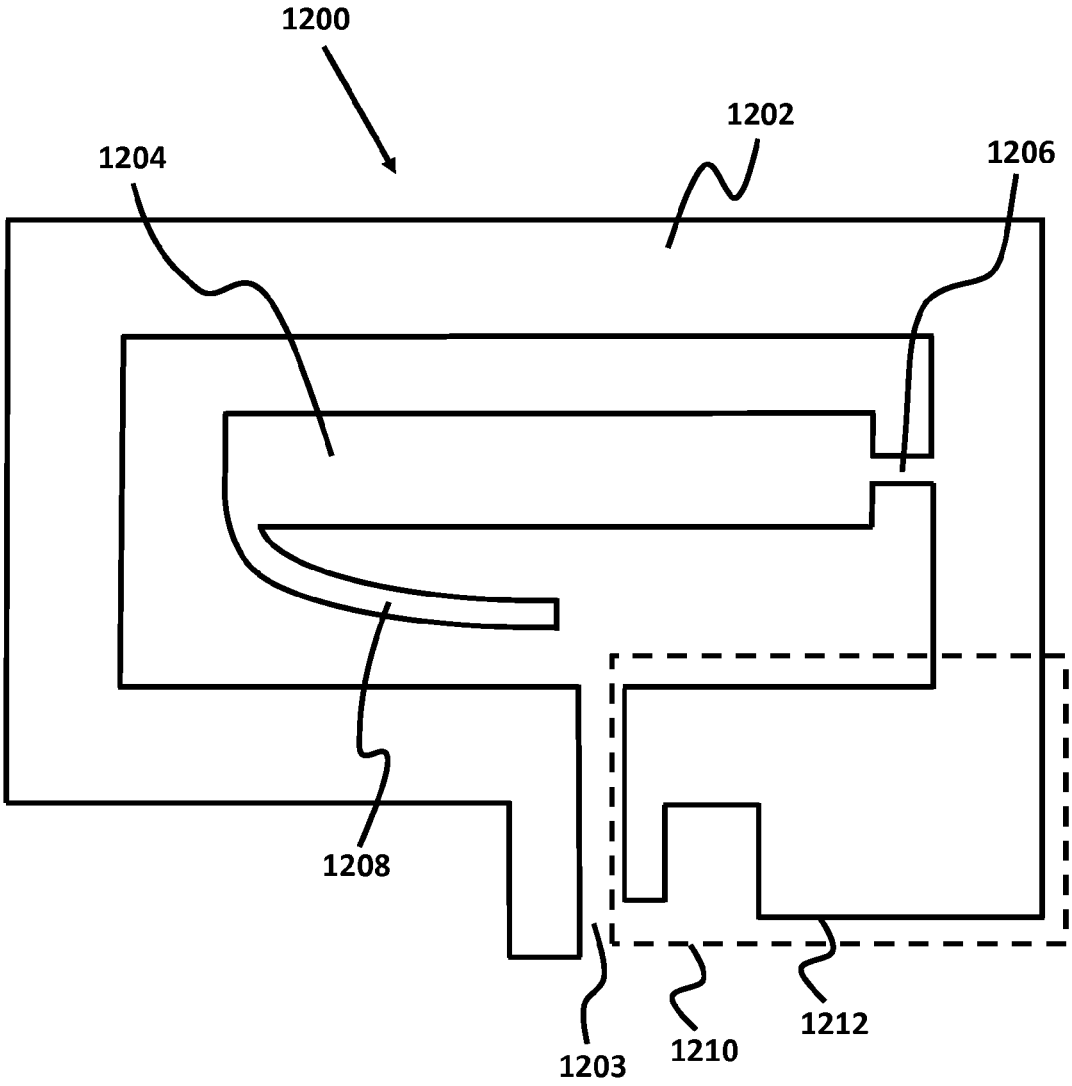
FIG. 12 illustrates an embodiment of a 2.4/5.8 GHz single-sided, multi-band CPL antenna, with a substantially curve shaped trace extending downward from the left side of the radiator and a rectangular brick extending downward from the first leg of the magnetic loop.

FIG. 12 illustrates an embodiment of a 2.4/5.8 GHz single-sided, multi-band CPL antenna 1200. The antenna 1200 includes a substantially rectangular magnetic loop 1202 and an electric field radiator 1204. The magnetic loop 1202 is discontinuous as illustrated by the gap 1203 between the two endpoints of the magnetic loop 1202. A trace 1206 couples the electric field radiator 1204 to the magnetic loop 1202. The inductive capacitance of the trace 1206 can be tuned by increasing its length, width, or by varying its physical shape from rectangular to curved. While the trace can have any desired shape, having a shape with soft curves and which minimizes the number of bends in the trace 1206 maximizes antenna performance. The electric field radiator 1204 can also be directly coupled to the magnetic loop 1202 without a trace 1206.

The electric field radiator 1204 resonates at the 2.4 GHz frequency band. A substantially curve shaped trace 1208 extends downward from the left side of the radiator 1204 and it is used as a method to increase the electrical length of and to tune the operation of the electric field radiator 1204. Specifically, changing the shape of trace 1208 shifts the resonance lower or higher in frequency depending on the desired frequency of operation. The trace 1208 can be tuned by increasing or decreasing the length of the trace 1208, by increasing or decreasing the width of the trace 1208, or by varying the shape of the trace 1208. The electrical length of the electric field radiator 1204 can also be tuned by increasing or decreasing the length of radiator 1204, increasing or decreasing the width of radiator 1204, or by modifying the shape of radiator 1204. In embodiments, the substantially curve shaped trace 1208 extends from the side of the radiator 1204 that is opposite to the side of the radiator 1204 coupled to the magnetic loop 1202. In antenna 1200, the trace 1208 extends from the left side of radiator 1204 because the right side of the radiator 1204 is coupled to the magnetic loop 1202. If the left side of the radiator 1204 had been coupled to the left side of the magnetic loop 1202, then the trace 1208 would extend from the right side of the radiator 1204. If the radiator 1204 had been coupled to the top side of the magnetic loop 1202, then the trace 1208 would extend from the bottom side of the radiator 1204, with the bottom side of the radiator 1204 being the side facing the gap 1203. In embodiments described herein, the use of a curved shape for the trace minimizes field cancellation.

The first leg of the magnetic loop, loop portion 1210, indicated by the dashed line in FIG. 12, is configured to create the resonant mode of the 5.8 GHz frequency band. The lower right portion 1210 of the magnetic loop 1202 includes a substantially rectangular brick 1212 extending downward from the magnetic loop 1202. The brick 1212 is used as a method of tuning the capacitance and inductance of the first leg of the magnetic loop. The first leg of the magnetic loop can be tuned by changing the width and length of the brick 1212, changing the shape of the brick 1212, or by changing the position of the brick 1212 along the first leg of the magnetic loop 1202.

Figure 13:
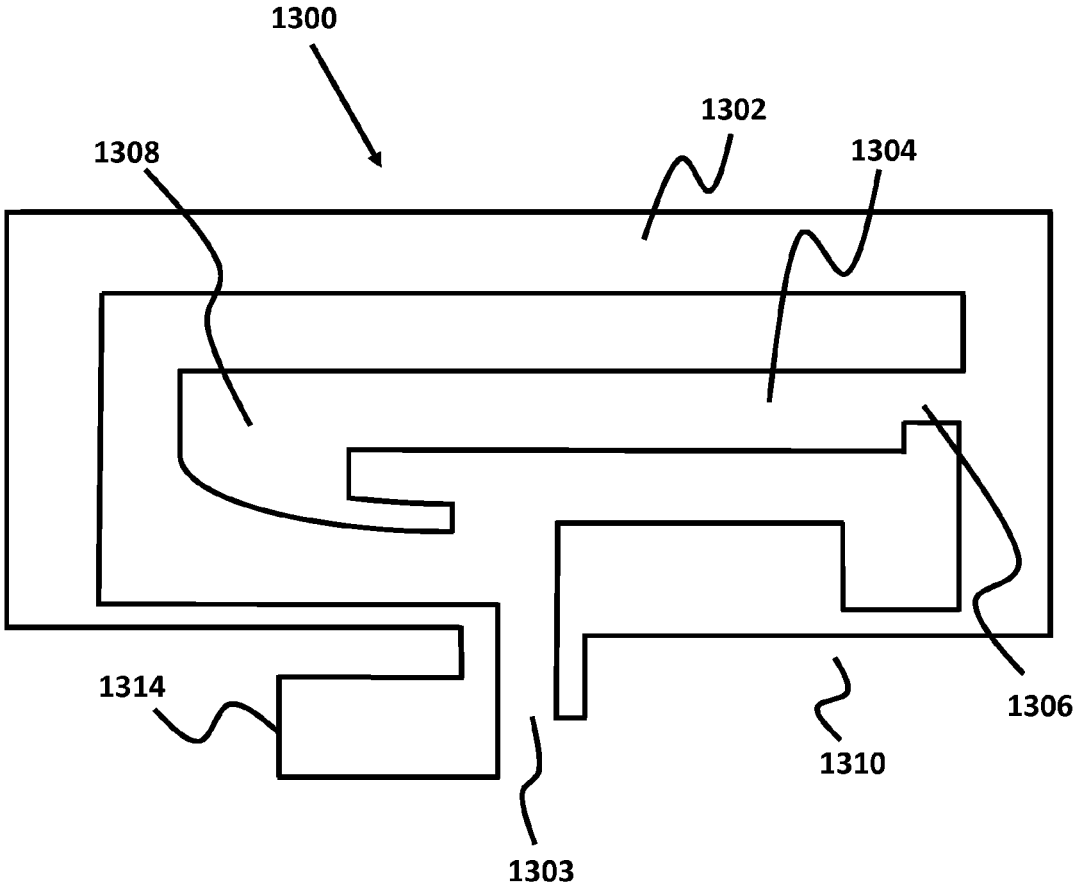
FIG. 13 illustrates an alternative embodiment of a 2.4/5.8 GHz single-sided, multi-band CPL antenna, with a substantially curve shaped trace extending downward from the left side of the radiator and a rectangular brick extending upward from the first leg of the magnetic loop.

FIG. 13 illustrates an alternative embodiment of a 2.4/5.8 GHz single-sided, multi-band CPL antenna 1300. The antenna 1300 includes a substantially rectangular magnetic loop 1302 and an electric field radiator 1304. Magnetic loop 1302 is also discontinuous as evident from the gap 1303 between the two endpoints of the magnetic loop 1302. Trace 1206 couples the electric field radiator 1304 to the magnetic loop 1302. As described above, the inductive capacitance of the trace 1306 can be tuned by varying its length, width, and shape.

The electric field radiator 1304 resonates at the 2.4 GHz band. The electric field radiator 1304 includes a trace 1308 extending downward from the left side of the radiator 1304. The trace 1308 is substantially curve shaped, with the portion of the trace 1308 adjacent to the radiator 1304 having a larger width than the distal portion of the trace 1308. The trace 1308 is used as a method for tuning the electrical length of the electric field radiator 1304 in order to shift the resonance lower or higher in frequency. Trace 1308 can be tuned by varying the length, width and shape of the portion proximal to the radiator 1304. Trace 1308 can also be tuned by varying the length, width and shape of the distal portion of the trace 1308. Trace 1308 can also consist of various portions, where a first portion has a width greater than the width of a second portion, and where the width of a third portion is different than the width of the third portion. Trace 1308 can also taper linearly from the portion proximal to the radiator 1304 to the distal portion of trace 1308. Overall, the actual shape of the trace 1308 can be different than the shape illustrated in FIGS. 12 and 13. The particular shape of the trace 1308 can be used as a method for impedance matching.

The first leg 1310 of the magnetic loop 1302 is configured to create the resonant mode of the 5.8 GHz frequency band. The lower right portion 1310 of the magnetic loop 1302 includes a brick 1312 that extends upward as a method of tuning the frequency and bandwidth of the antenna 1300. The antenna 1300 can be tuned by changing the length, width, and shape of brick 1312. The antenna 1300 can also be tuned by changing the position of the brick 1312 along the first leg

1310 of the magnetic loop, or by changing how the brick 1312 extends from the magnetic loop, either upward or downward. Brick 1314 is used for impedance matching. In embodiments described herein, one or more bricks positioned along various sections of the magnetic loop can be used as a method for tuning impedance matching. It is to be understood embodiments without bricks or with or without other impedance matching components are within the scope and spirit of the invention. For example, the geometry of one or more components of the antenna can also be varied to achieve the same impedance matching that is achieved with the use of bricks or other shaped components. Likewise, the width of one or more portions of the magnetic loop can be varied to tune the impedance.

While the present disclosure illustrates and describes a preferred embodiment and several alternatives, it is to be understood that the techniques described herein can have a multitude of additional uses and applications. Accordingly, the invention should not be limited to just the particular description and various drawing figures contained in this specification that merely illustrate various embodiments and application of the principles of such embodiments.

What is claimed is:

1. A multi-layered planar multi-band antenna, comprising:

a magnetic loop located on a first plane and configured to generate a magnetic field, the magnetic loop forming two or more horizontal sections and two or more vertical sections formed at substantially 90 degree angles between the two or more horizontal sections and the two or more vertical sections, a first horizontal section among the two or more horizontal sections emitting a first electric field at a low frequency band, a second horizontal section among the two or more horizontal sections emitting a second electric field at a high frequency band, wherein the magnetic loop has a first inductive reactance adding to a total inductive reactance of the multi-band antenna; and a parasitic electric field radiator located on a second plane below the first plane, at least half of the parasitic electric field radiator positioned on the second plane at a position that would place the electric field radiator within the magnetic loop if the position was on the first plane, the parasitic electric field radiator not coupled to the magnetic loop, the parasitic electric field radiator configured to emit a third electric field at the low frequency band that reinforces the first electric field and orthogonal to the magnetic field, wherein the parasitic electric field radiator has a first capacitive reactance adding to a total capacitive reactance of the multi-band antenna, wherein a physical arrangement between the electric field radiator and the magnetic loop results in a second capacitive reactance adding to the total capacitive reactance, and wherein the total inductive reactance substantially matches the total capacitive reactance.

2. The antenna as recited in claim 1, wherein the parasitic electric field radiator reflects an impedance into the magnetic loop and realigns the first electric field and the second electric field parallel to the third electric field.

3. The antenna as recited in claim 1, wherein positioning the parasitic electric field radiator near an edge of the magnetic loop along the second plane increases an electrical length of the parasitic electric field radiator.

4. The antenna as recited in claim 1, wherein positioning the parasitic electric field radiator near a center of the magnetic loop along the second plane decreases an electrical length of the electric field radiator.

5. The antenna as recited in claim 1, wherein one or more first corners of the two or more horizontal sections and one or more second corners of the one or more vertical sections are cut at an angle.

6. The antenna as recited in claim 1, wherein the two or more horizontal sections and the one or more vertical sections are arranged to make one or more high voltage nodes within the magnetic loop and one or more high current nodes within the magnetic loop additive at the high frequency band and the low frequency band.

7. The antenna as recited in claim 1, wherein one or more additive sections among the one or more vertical sections, and one or more canceling sections among the one or more vertical sections, tune an electrical length of the magnetic loop to substantially match one wavelength, wherein the one or more additive sections add capacitance to the magnetic loop and the one or more canceling sections decrease a length of the magnetic loop.

8. The antenna as recited in claim 1, further comprising a loading capacitor located on the second plane, the loading capacitor having a third capacitance reactance adding to the total capacitive reactance.

9. The antenna as recited in claim 1, wherein the loading capacitor is oriented orthogonal to the first electric field and the second electric field.

10. The antenna as recited in claim 1, wherein the low frequency band and the high frequency band are not harmonically related.

* * * * *